United States Patent [19]

Cowan

[11] 4,445,807

[45] * May 1, 1984

[54] DIVERLESS SUBSEA TEMPLATE LEVELLING SYSTEM AND METHOD

[75] Inventor: William S. Cowan, West University Place, Tex.

[73] Assignee: Armco Inc., Middletown, Ohio

[ * ] Notice: The portion of the term of this patent subsequent to Oct. 11, 2000 has been disclaimed.

[21] Appl. No.: 328,791

[22] Filed: Dec. 8, 1981

Related U.S. Application Data

[63] Continuation-in-part of Ser. No. 221,398, Dec. 30, 1980.

[51] Int. Cl.[3] ..... E02B 17/02

[52] U.S. Cl. ..... 405/227; 405/199; 405/202

[58] Field of Search ..... 405/169, 191, 227, 228, 405/196, 199, 202, 224; 24/263 DA, 263 SB, 263 SW; 254/29 R, 30, 228

[56] References Cited

U.S. PATENT DOCUMENTS

| | | | |
|---|---|---|---|
| 2,810,552 | 10/1957 | Martin | 24/263 DA X |
| 3,101,798 | 8/1963 | Wilson et al. | 24/263 DA X |
| 3,310,108 | 3/1967 | Yancey | 166/351 |
| 3,504,740 | 7/1970 | Manning | 166/362 |
| 3,570,032 | 3/1971 | Allen | 405/199 |
| 3,672,177 | 6/1972 | Manning | 405/227 |
| 4,041,711 | 8/1977 | Lucas | 61/91 |
| 4,069,682 | 1/1978 | Taylor et al. | 405/202 |
| 4,086,778 | 5/1978 | Latham et al. | 405/191 |
| 4,127,991 | 12/1978 | Regan | 405/202 |
| 4,161,376 | 7/1979 | Armstrong | 405/196 |
| 4,161,807 | 7/1979 | Swenson | 24/263 SW |
| 4,212,562 | 7/1980 | Stone et al. | 405/195 |
| 4,306,339 | 12/1981 | Ward | 24/263 DA |
| 4,322,182 | 3/1982 | Ostgaard | 405/227 |

*Primary Examiner*—David H. Corbin

*Attorney, Agent, or Firm*—Roylance, Abrams, Berdo & Goodman

[57] ABSTRACT

A diverless system for levelling a template adjacent the floor of a body of water comprising a plurality of fluid-pressure activated gripping assemblies pivotally coupled to the template and receiving the supporting piles therein, with portions of the piles extending above the template; and a jacking assembly capable of being lowered down each of the piles, releasably connected to the template adjacent the associated gripping assembly and raising or lowering the template in the area each of each pile to level the template. The jacking assembly comprises an outer housing, and a double acting hydraulic piston slidably received in the housing, with a pile gripping assembly being coupled to the piston. The gripping assembly in the jacking assembly and those in the template are each formed from a plurality of ring segments that are serrated on the inside and have tapered ribs on the outside, these segments being received in a bowl having corresponding tapered ribs. The segments are spring biased upwardly and inwardly into the pile gripping position and released downwardly and outwardly by hydraulically actuated pistons. Without diver intervention, fluid under pressure is delivered to the gripping assemblies coupled to the template.

The method of installing the template comprises landing the template on the floor of the body of water, passing a set of casing piles through passageways in the template and implanting the casing piles in the floor of the body of water with portions of the piles extending above the template, levelling the template, and rigidly connecting the levelled template to the piles. The step of levelling the template includes actuating the gripping assemblies coupled to the template. This step is preceded by the step of remotely delivering fluid under pressure from a fluid reservoir at the surface of the sea to each gripping assembly without underwater manual, i.e., diver, intervention.

23 Claims, 37 Drawing Figures

PUMP
VENT
CONNECTOR UNLOCK
POSITION INDICATORS
RETRACTED
EXTENDED
BALL SLIPS UNLOCK
JACK SLIPS UNLOCK
#1
#2
#3
#4
#5
EXTEND
RETRACT
180
181
204
205
206
207
208
209
210
211
212
213
115
117
118
119
120
129
132
133
136
137
138
139
140
145
146
148
149
151
152
162
164
168
169
173
182
183
184
185
186
18
54
82a-f
124

136
138
145
146
188
189
190
191
192
193
194
195
196
197
198
199
200
201

DIVERLESS SUBSEA TEMPLATE LEVELLING SYSTEM AND METHOD

RELATED APPLICATIONS

This application is a continuation-in-part of copending U.S. application Ser. No. 221,398, filed Dec. 30, 1980, entitled Subsea Template Levelling System And Method in the name of William S. Cowan.

FIELD OF THE INVENTION

The invention relates to a diverless system and method for installing and levelling a production or drilling template adjacent the floor of a body of water. The template is first landed on the floor of the body of water; next casing piles are passed through fluid-pressure activated gripping assemblies pivotally coupled to the template and then into the floor, with portions of the piles extending above the template; and then a jacking assembly is lowered down each pile, releasably coupled to the template and actuated to raise or lower the template adjacent each pile to level the overall template. The jacking assembly comprises a housing, a double acting hydraulic piston slidably received in the housing and a releasable gripping assembly secured inside the piston. Without diver intervention, fluid under pressure is delivered to the gripping assemblies coupled to the template.

BACKGROUND OF THE INVENTION

In recent years, the search for oil and gas has concentrated on the formations below the surface of the oceans, seas and lakes of the world. During such exploration and the subsequent production of the oil and gas from the formation lying below the floor of the body of water, it is advantageous to drill a plurality of well holes close together and in a known orientation. As a result, large templates are used for this guidance purpose, usually consisting of a substantially planar array of tubes coupled together in a lattice and having a certain number of slots formed therein for receiving drill pipe, or pipe for conducting the oil and the gas upwardly from the floor of the body of water after the production well is established.

The use of such templates, however, includes many difficulties. For example, the floor of a body of water, such as the seabed, is usually inclined and irregular, therefore requiring some type of levelling device for the template. In addition, such a template is usually maintained on the seabed for a long period of time and therefore is very difficult to maintain or repair. Moreover, many systems for levelling templates require costly and dangerous underwater diver intervention.

Examples of prior systems directed to levelling such templates are disclosed in U.S. Pat. Nos. 3,310,108 to Yancey; 3,504,740 to Manning; 4,127,991 to Regan; and 4,212,562 to Stone et al. Additional prior art devices that disclose levelling of platforms of various types include U.S. Pat. Nos. 2,839,164 to Roussel; 2,873,580 to Suderow; 2,994,403 to Smith; and 3,750,032 to Allen.

SUMMARY OF THE INVENTION

Accordingly, a primary object of the invention is to provide a diverless system and method for installing and levelling a production or drilling template adjacent the floor of a body of water where the floor is inclined or of uneven contour.

Another object of the invention is to provide such a system that reduces maintainance problems.

Another object of the invention is to provide a compact jacking assembly to level the template that is retrievable for ease of maintenance.

Another object of the invention is to provide a plurality of gripping assemblies on the template that grip the piles supporting the template and that are retrievable for maintenance purposes.

Another object of the invention is to provide a jacking assembly that can jack the template up or down with infinite variation.

Another object of the invention is to provide such a system that has no special pile configuration and that has a fail safe gripping mechanism in case of loss of hydraulic pressure.

Another object of the invention is to provide such a system that takes into account deflection of the casing piles upon levelling of the template and that can eliminate such potential deflection of the piles.

The foregoing objects are basically attained by providing a subsea template levelling system for levelling a template adjacent the seabed on a plurality of piles implanted in the seabed, the combination comprising an open ended hub having a pile received therein; a mechanism for pivotally coupling the hub to the template in a passageway in the template; a first fluid-pressure activated gripping assembly, coupled to the hub, for releasably gripping the pile received in the hub; a housing; a mechanism for releasably coupling the housing to the hub; a second gripping assembly, slidably received in the housing, for releasably gripping the pile received in the hub; an assembly on the exterior of the second gripping assembly and on the interior of the housing for limiting the slidable movement of the second gripping assembly relative to the housing; a mechanism for unlocking and locking the first and second gripping assemblies and for reciprocating the second gripping assembly relative to the housing to raise and lower the template relative to the pile received in the hub; and a mechanism for remotely delivering fluid under pressure from a fluid reservoir at the surface of the sea to the first gripping assembly without the necesity for an underwater manual connection.

Advantageously, the combination of the housing and the second gripping assembly is formed as a retrievable jacking assembly that can be maneuvered to each of the piles supporting the template. The housing forms a hydraulic cylinder with an internal flange and the second gripping assembly comprises a double acting hydraulic piston having external flanges on opposite sides of the internal flange in the housing, and a set of slips or ring segments received in the piston for gripping the pile.

The first gripping assembly is also formed from a plurality of slips, or ring segments, coupled to the inside of the hub which is in turn connected to the template by means of a ball joint.

The ring segments in the first and second gripping assemblies are biased upwardly and inwardly into a pile gripping position by means of compression springs and are moved downwardly and outwardly into a pile releasing position by means of a plurality of hydraulically actuated pistons.

The foregoing objects are also basically attained by a method for installing a template adjacent the floor of a body of water with the steps comprising lowering the template throught the water, landing the template on the floor of the body of water, lowering a set of casing piles through the water, passing the set of casing piles through passageways in the template and implanting the casing piles in the floor of the body of water with portions of the casing piles extending above the template, levelling the template, and rigidly connecting the levelled template to the set of casing piles. The step of levelling the template includes actuating the gripping assemblies coupled to the template. This step is preceded by the step of remotely delivering fluid under pressure from a fluid reservoir at the surface of the sea to each gripping assembly without underwater, e.g., diver, intervention.

The levelling step can also include lowering a jacking assembly one at a time, or in seriatim, down each casing pile, releasably connecting the jacking assembly to that portion of the template adjacent the casing pile and jacking that portion of the template adjacent the casing pile up or down.

During the levelling step, the casing piles can be deflected transverse to their longitudinal axes due to the rigid structure of the template and the lack of play between the piles and the template. Alternatively, during the levelling step, the potential deflection can be eliminated by introducing radial play between the template and the piles.

Other objects, advantages and salient features of the present invention will become apparent from the following detailed description, which, taken in conjunction with the annexed drawings, disclose advantageous embodiments of the inention.

DRAWINGS

Referring now to the drawings which form a part of this original disclosure:

Figure 5:
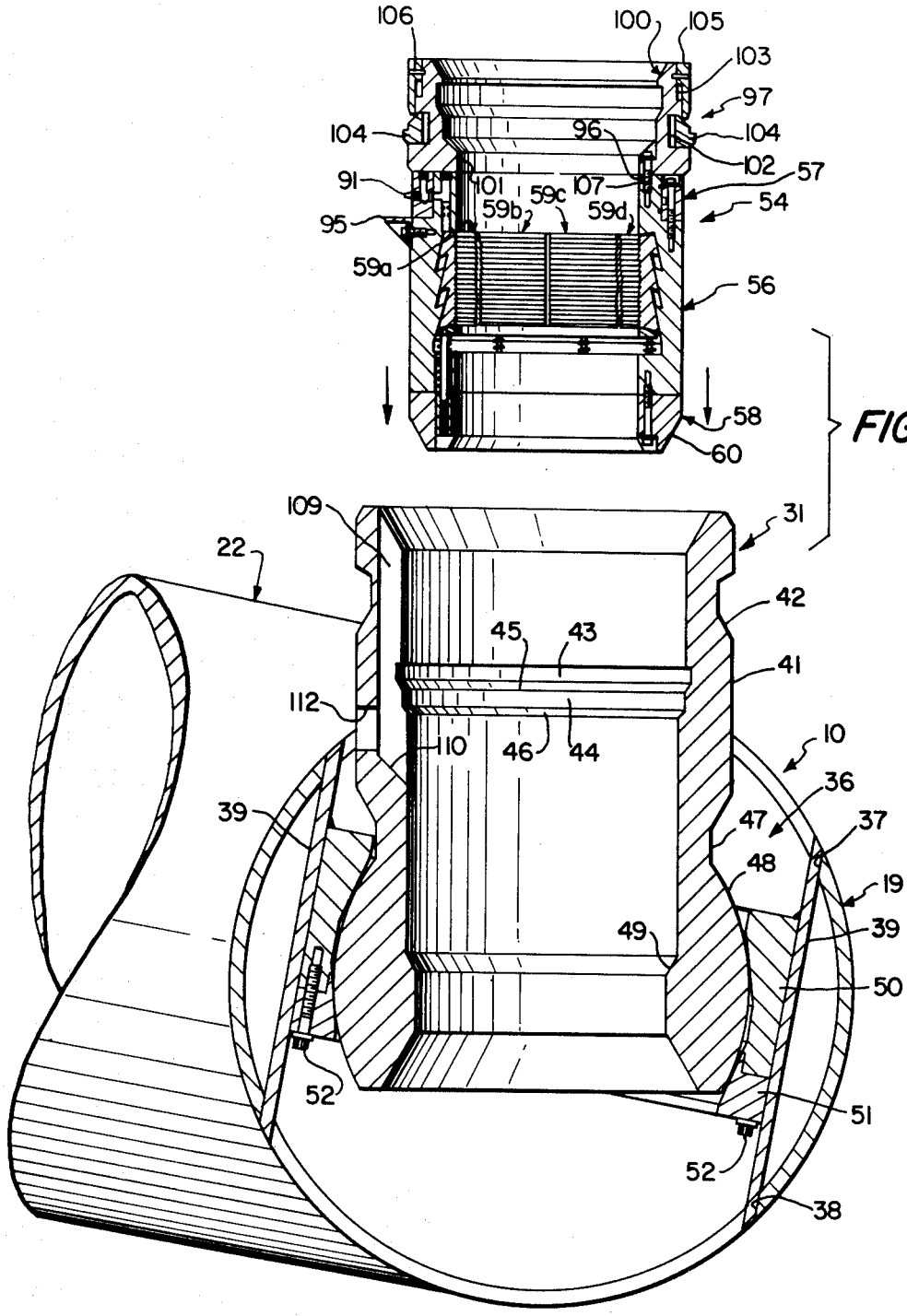
FIG. 5 is a side elevational view in section taken along lines 5—5 in FIG. 2 showing a passageway in a pipe forming part of the template and pivotally supporting a hub therein with a pile gripping assembly about to be landed in the hub.
Figure 10:
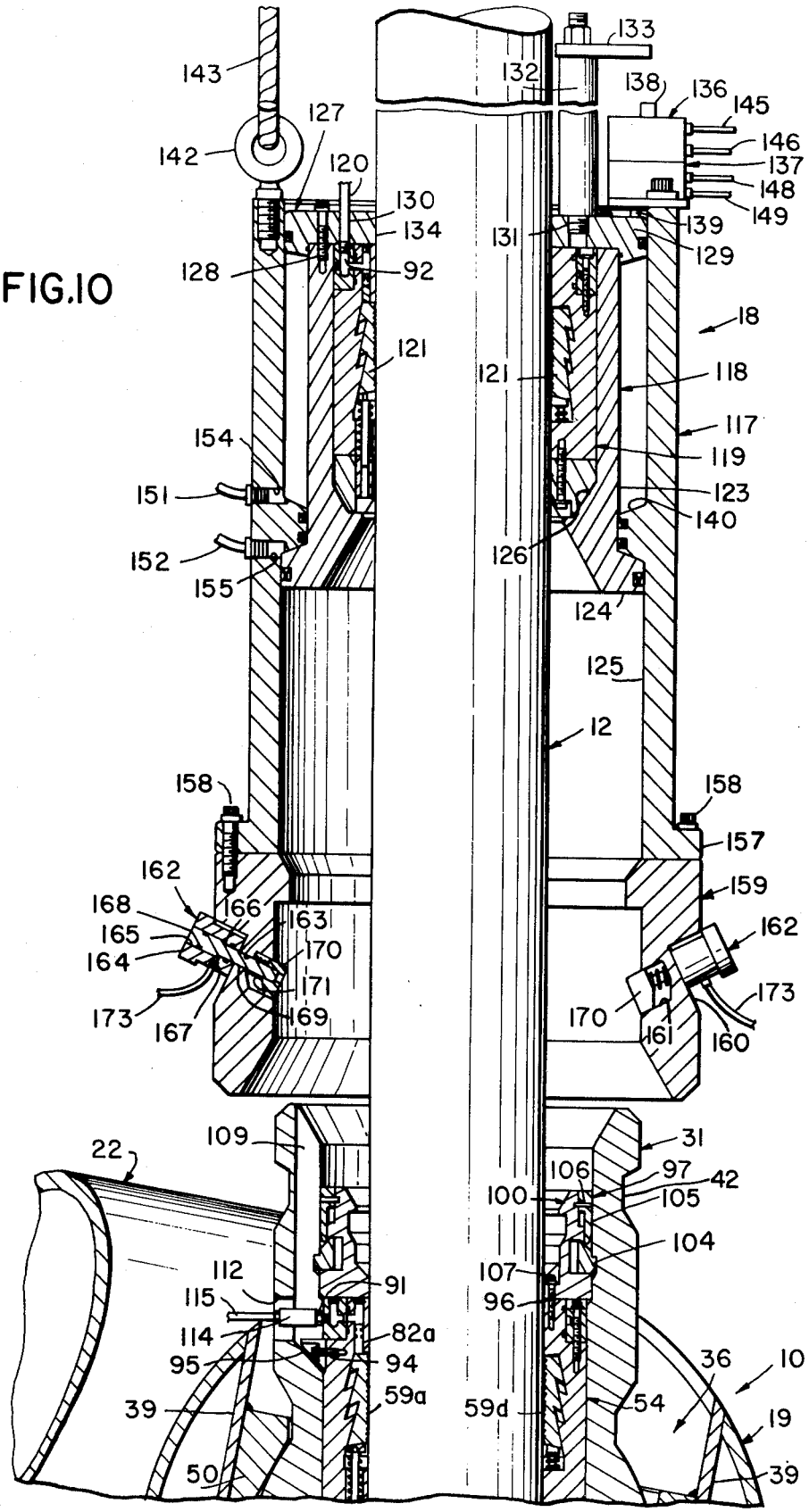
FIG. 10 is a side elevational view in section similar to that shown in FIG. 5 except that the gripping assembly has been fully landed in the hub in the template and a pile has been passed through the gripping assembly, the jacking assembly being shown supported on the pile and about to be connected to the hub.
Figure 26:
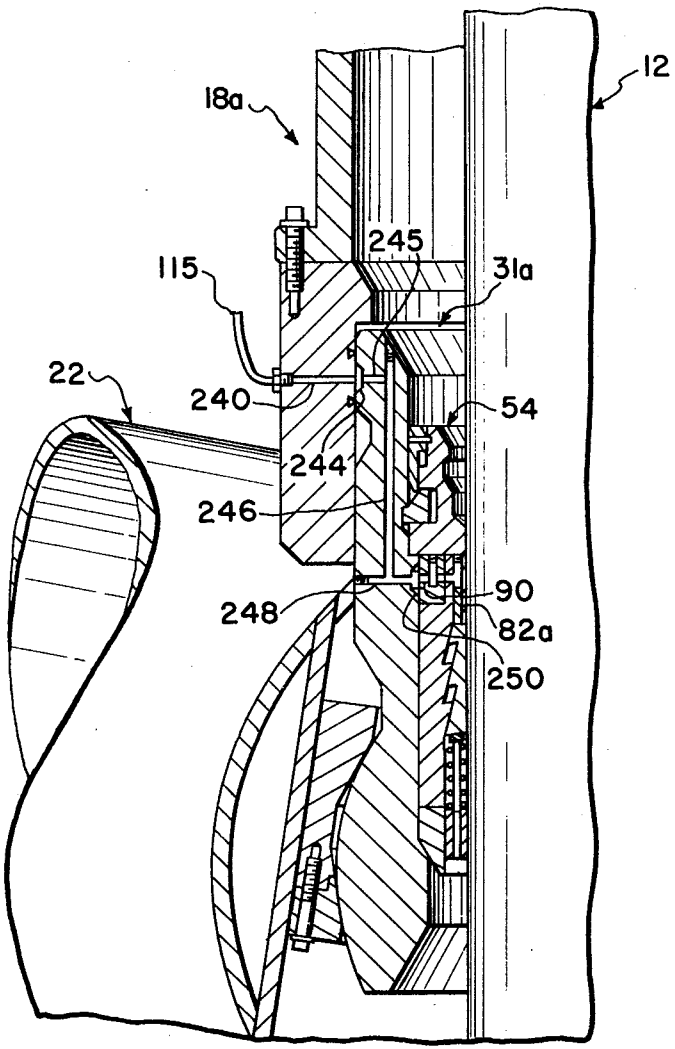
Figure 25:
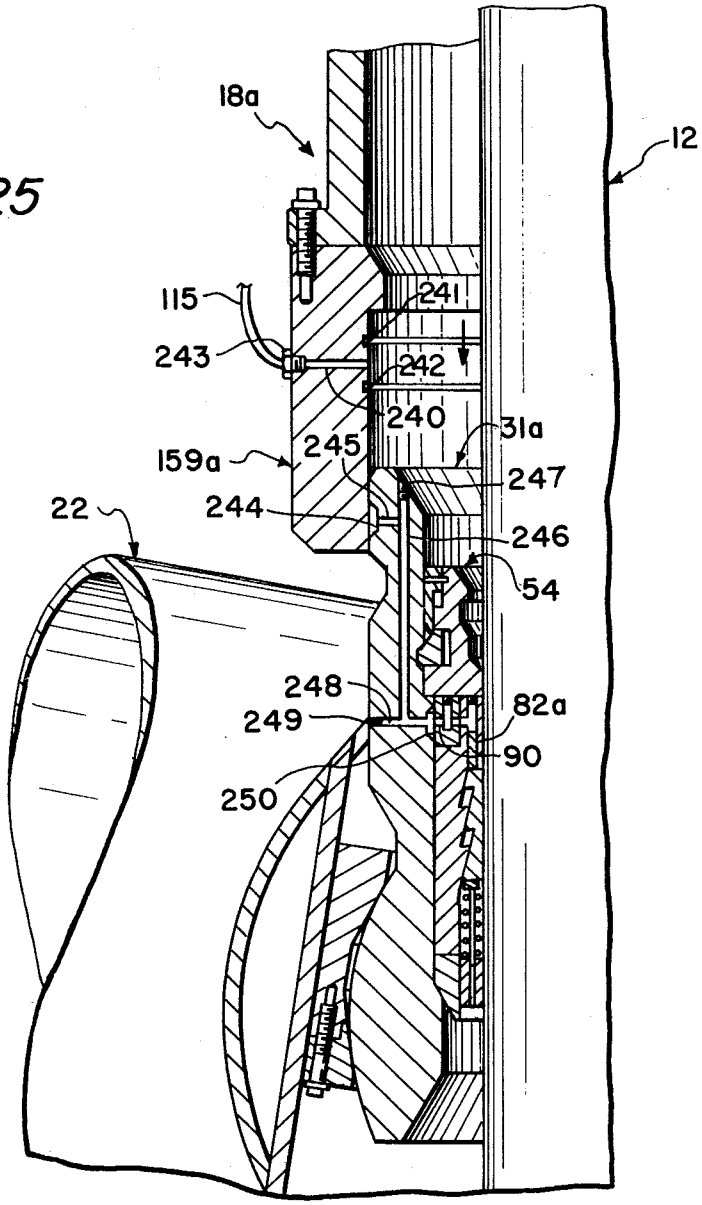
Figure 28:
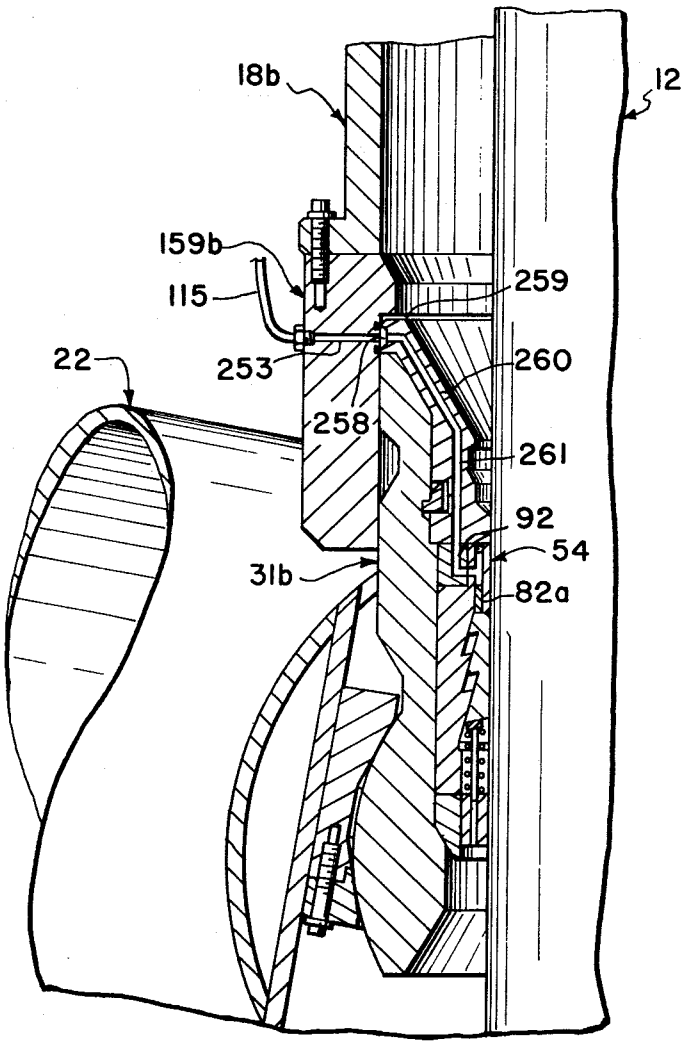
Figure 27:
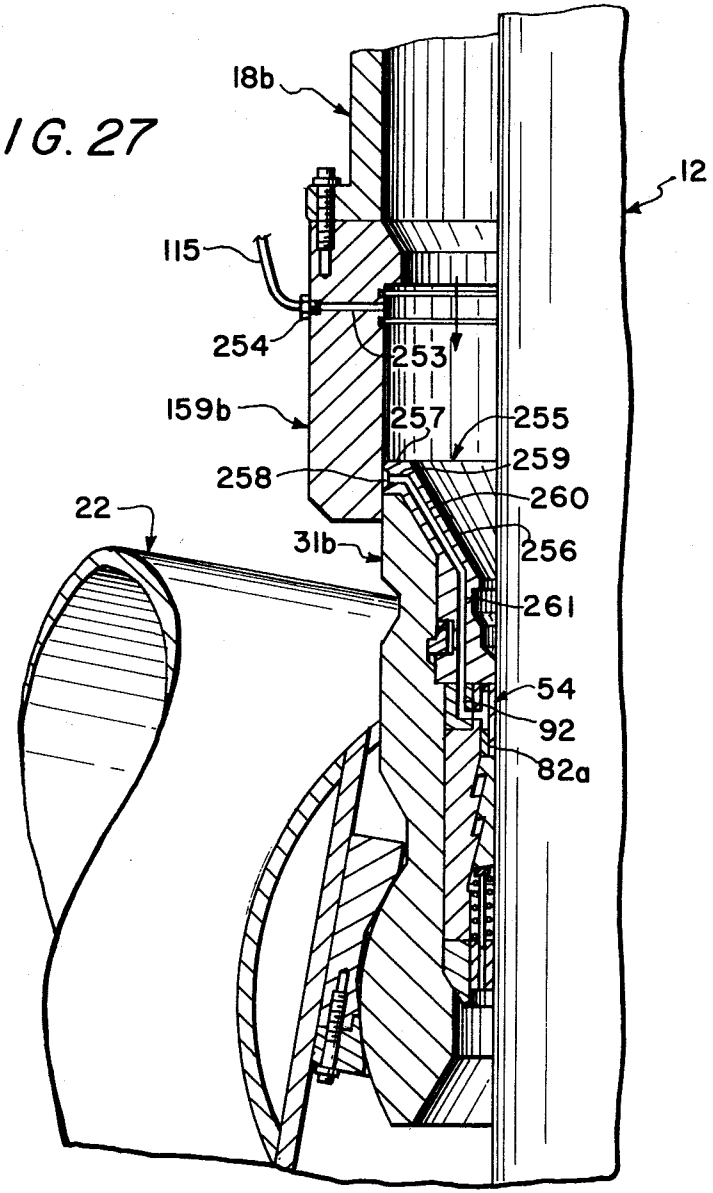
Figure 30:
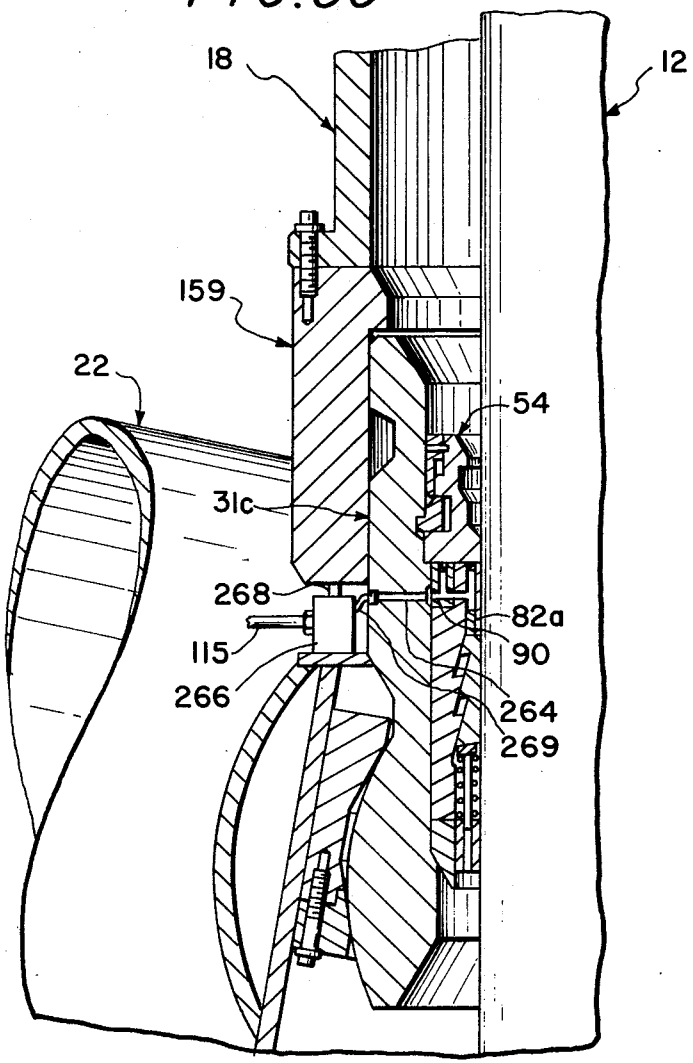
Figure 29:
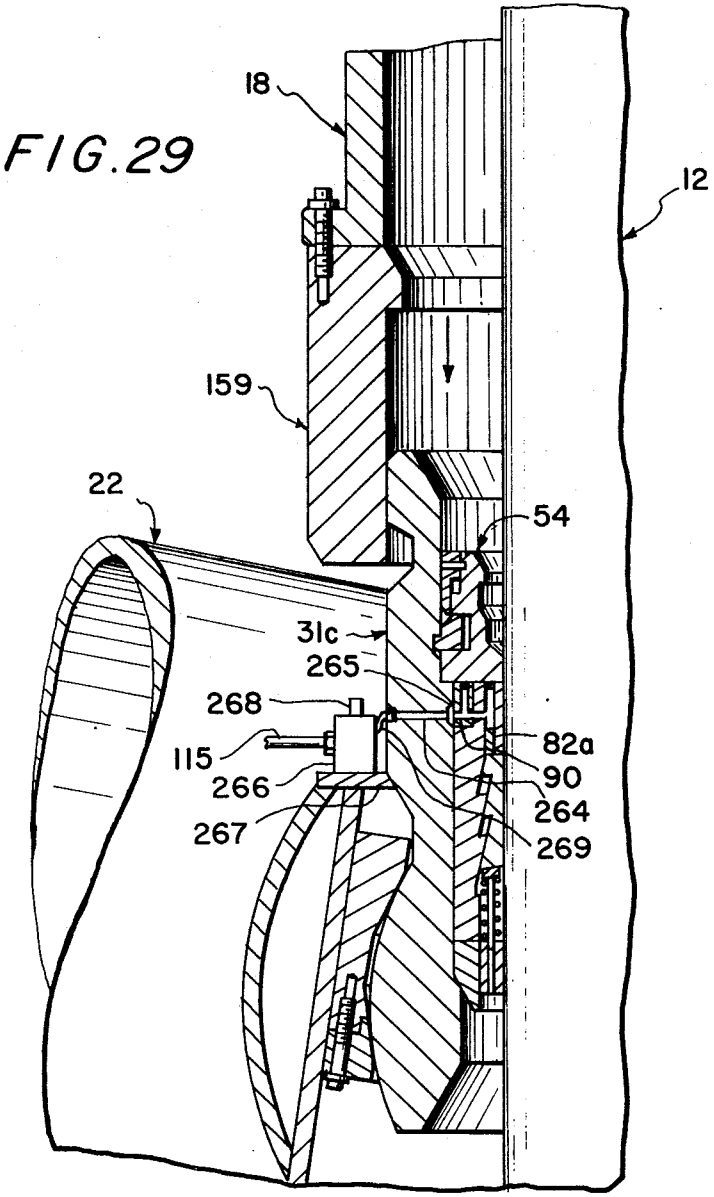
Figure 32:
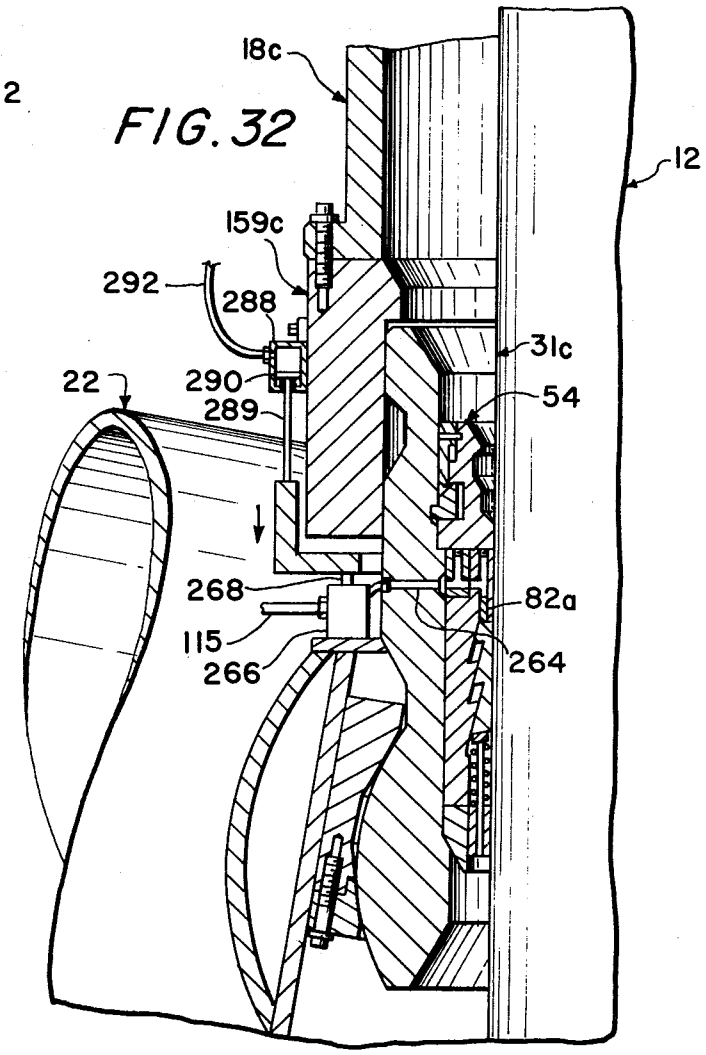
Figure 31:
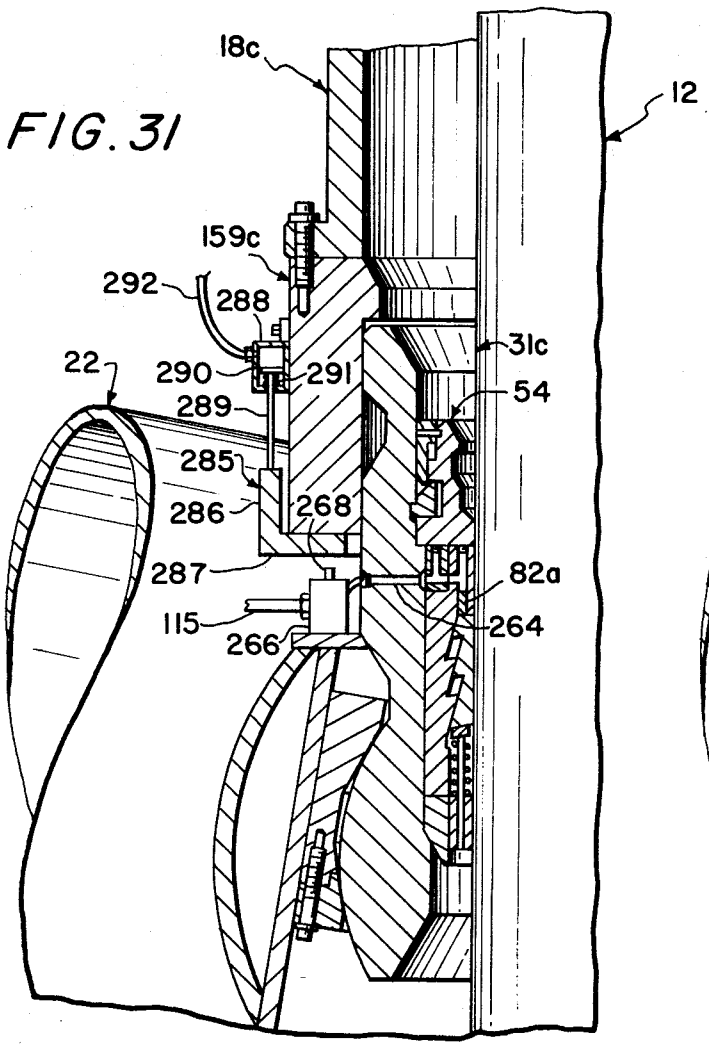
Figure 33:
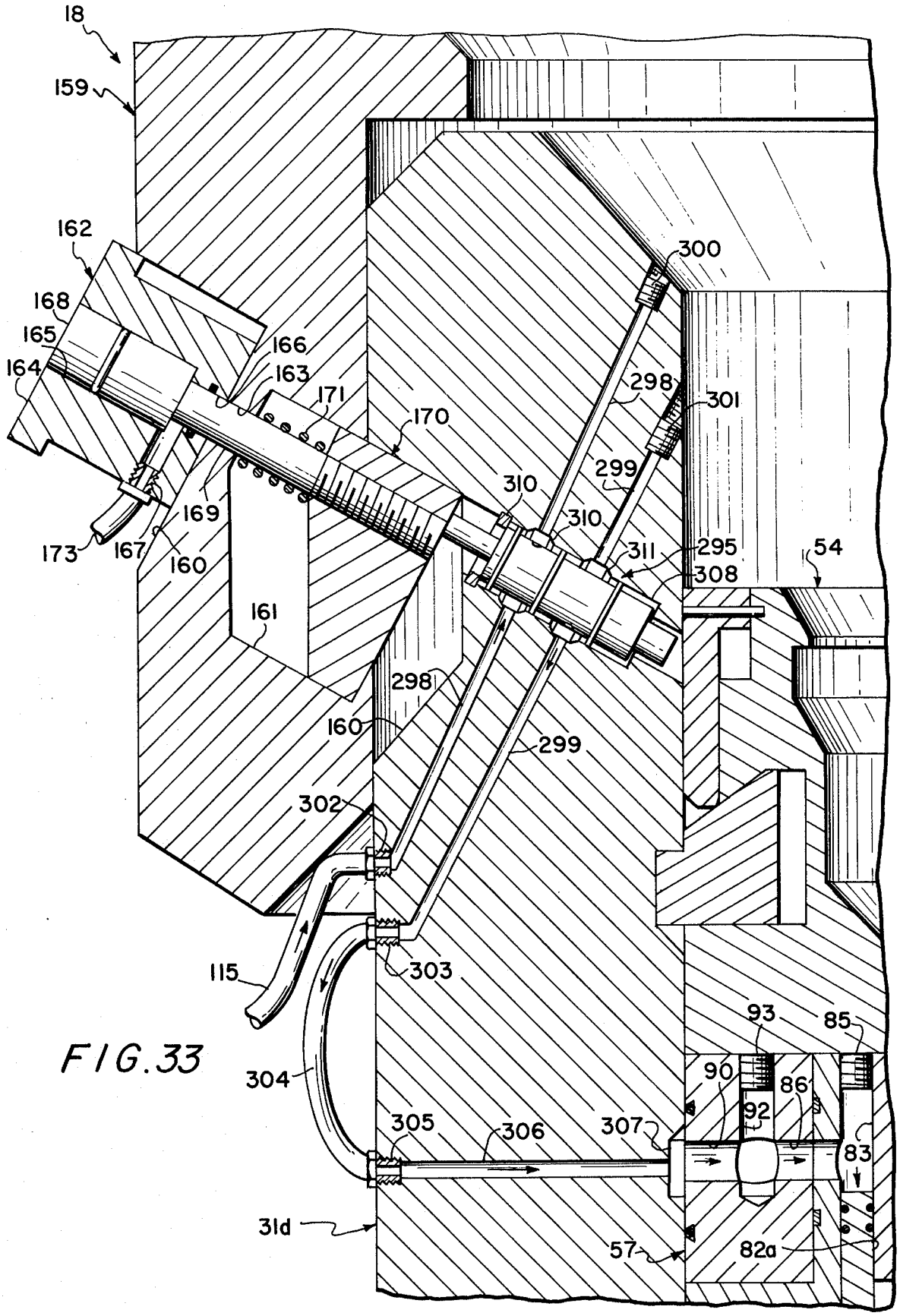
Figure 34:
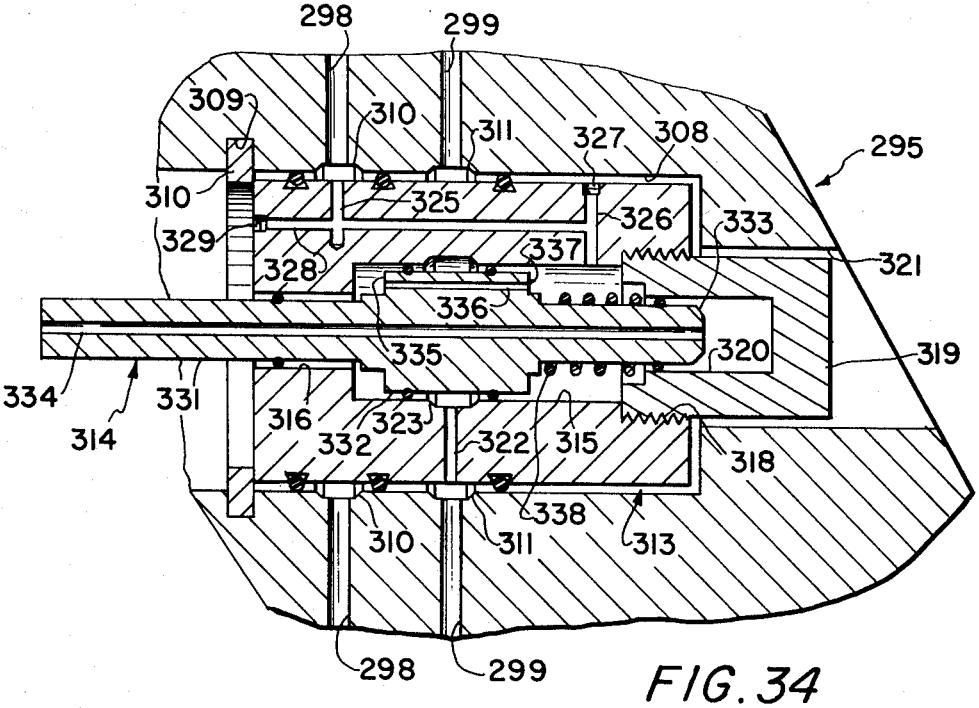
Figure 35:
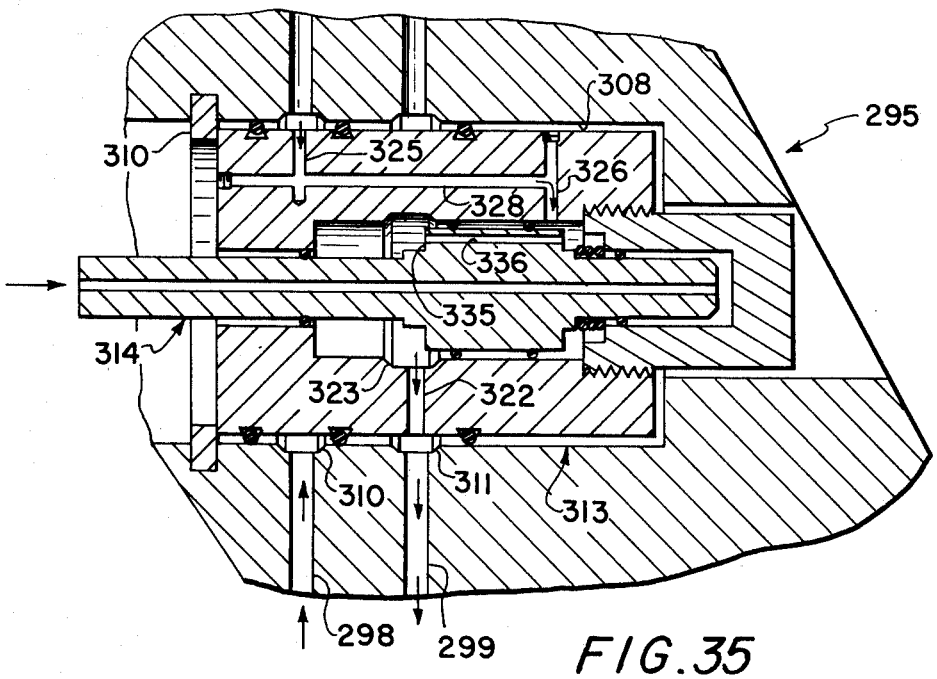
Figure 37:
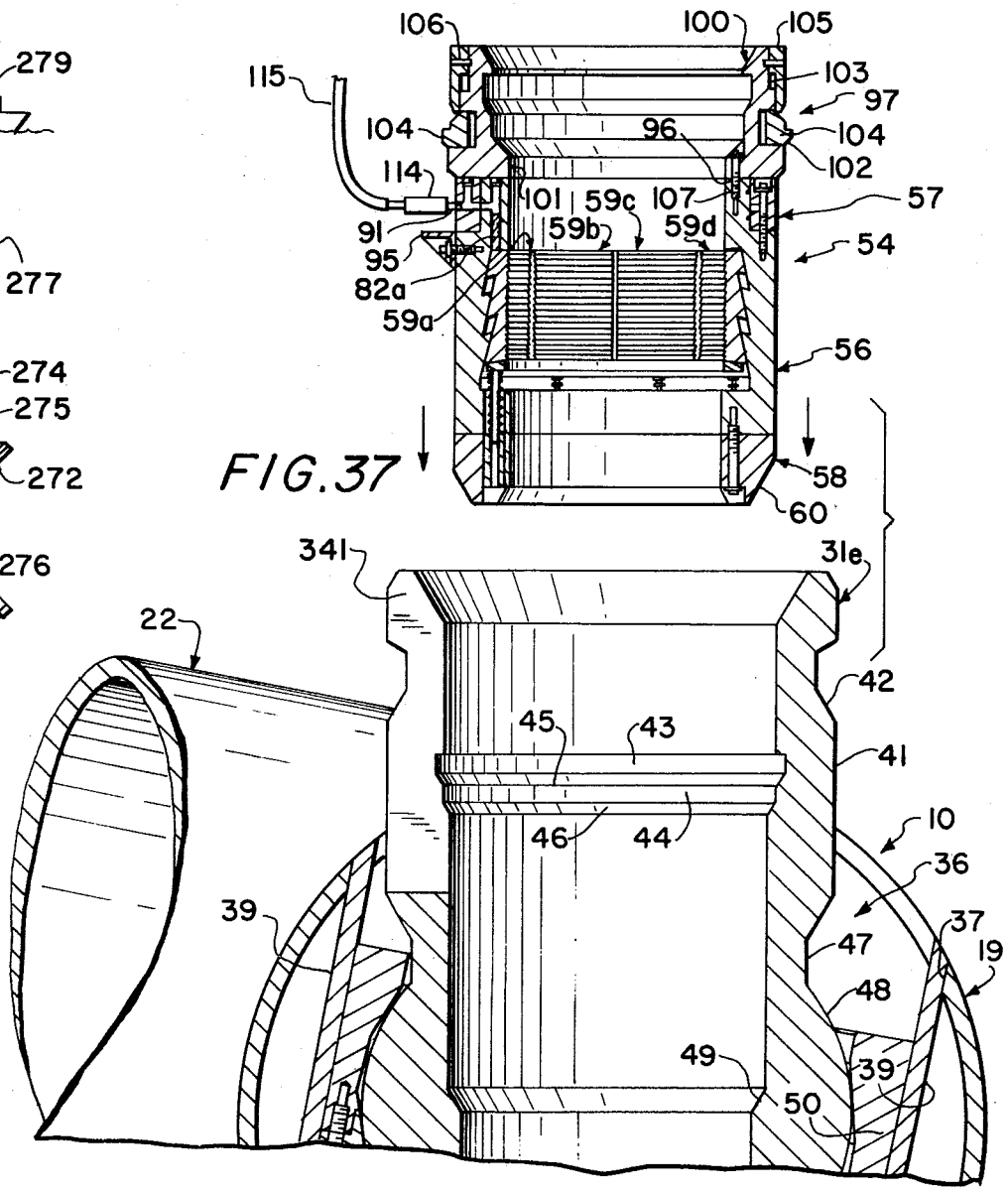
Figure 36:
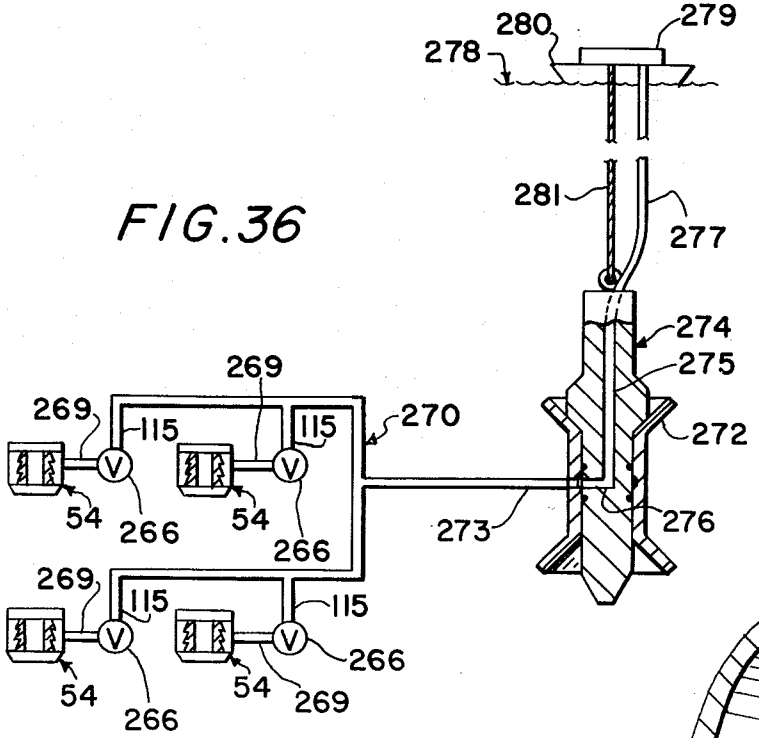

FIG. 25 is a side elevational view in section similar to that shown in FIG. 10 but showing a first modified embodiment to render the apparatus diverless in which the gripping assembly has been fully landed in the hub in the template and a pile has been passed through the gripping assembly, the jacking assembly being shown supported on the pile and about to be connected to the hub, which connection will allow fluid under pressure to be delivered to the gripping assembly;

FIG. 26 is a side elevational view in section of the apparatus shown in FIG. 25 with the jacking assembly connected to the hub;

FIG. 27 is a side elevational view in section similar to that shown in FIG. 25 but showing a second modified embodiment to render the apparatus diverless;

FIG. 28 is a side elevational view in section of the apparatus shown in FIG. 27 with the jacking assemlby connected to the hub;

FIG. 29 is a side elevational view in section similar to that shown in FIG. 25 but showing a third modified embodiment to render the apparatus diverless utilizing a valve coupled to the hub;

FIG. 30 is a side elevational view in section of the apparatus shown in FIG. 29 with the jacking assembly connected to the hub and opening the valve;

FIG. 31 is a side elevational view in section similar to that shown in FIG. 30 with the jacking assembly connected to the hub but showing a fourth embodiment to render the apparatus diverless utilizing a separate valve actuator coupled to the jacking assembly;

FIG. 32 is a side elevational view in section of the apparatus shown in FIG. 31 with the valve actuator engaging a pushbutton on the valve to open the valve;

FIG. 33 is an enlarged side elevational view in section of a fifth embodiment to render the apparatus diverless with a spool valve received in the hub and actuated by a locking dog used to couple the jacking assembly to the hub;

FIG. 34 is an enlarged elevational view in longitudinal section of the spool valve shown in FIG. 33, the valve being in the closed position;

FIG. 35 is a view similar to that shown in FIG. 34 except that the spool valve is in the open position;

FIG. 36 is a diagramatic illustration of a fluid manifold coupled to the template and having a connection with a fluid reservoir at the surface and a plurality of connections with the gripping assemblies for each of the piles used to level the template; and FIG. 37 is a side elevational view in section similar to that shown in FIG. 5 but showing a sixth embodiment to render the apparatus diverless in which the gripping assembly is coupled to a fluid pressure line and is about to be landed in the hub with the fluid pressure line being receivable in a slot in the wall of the hub.

DETAILED DESCRIPTION OF THE INVENTION

Referring now to FIGS. 1-5 in detail, the system in accordance with the invention comprises a template 10 to be levelled by means of a retrievable jacking assembly 18 on a plurality of casing piles 12 that are implanted in the floor 14 of a body of water 16.

Figure 1:
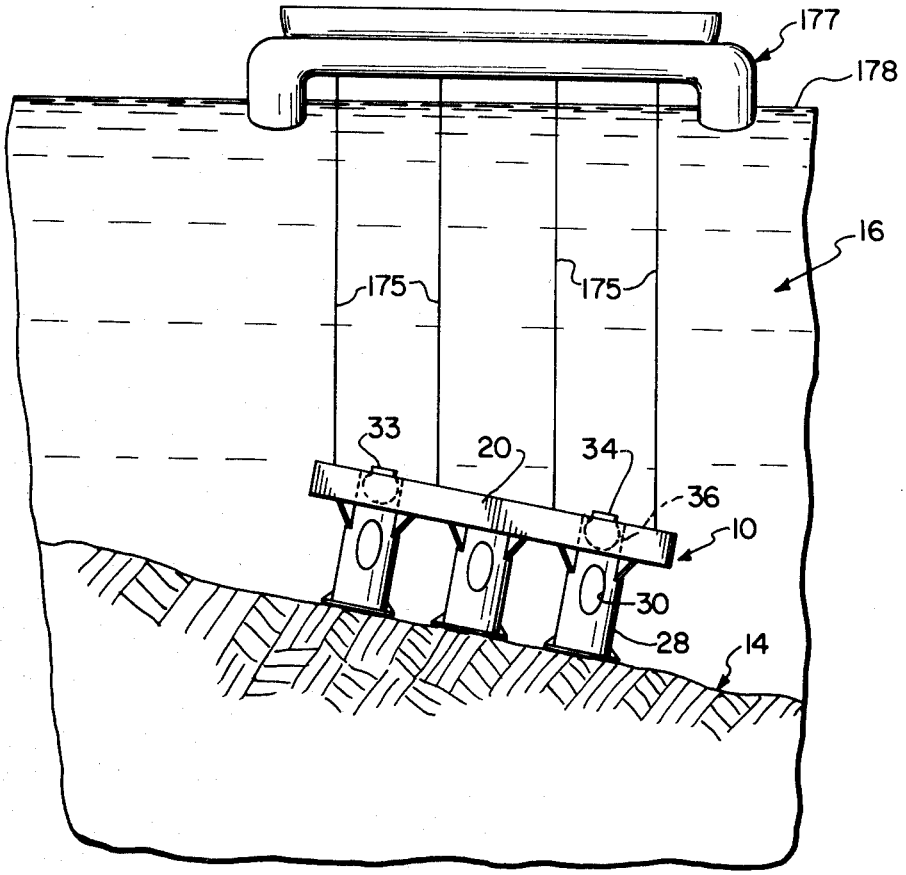
FIG. 1 is a diagramatic representation of a template landed on the inclined floor of a body of water by use of guidelines extending from a vessel on the surface of the water.
Figure 2:
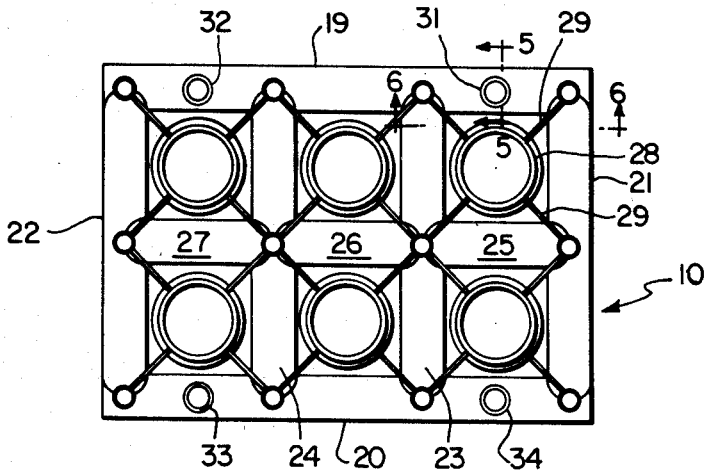
FIG. 2 is a top plan view of the template shown in FIG. 1 with slots in a two by three array.

As specifically seen in FIGS. 1 and 2, the template 10 is comprised of two parallel pipes 19 and 20 coupled at their ends to form a rectangle with two other parallel pipes 21 and 22, with two additional internal pipes 23 and 24 extending between pipes 19 and 20 and with three shorter pipes 25, 26 and 27 interconnecting respectively pipes 21 and 23, 23 and 24 and 24 and 22. As seen in FIG. 2 these pipes are evenly spaced and are rigidly coupled, such as by welding, to define a lattice in substantially a single plane, the lattice having six rectangular slots therein. Each of these slots has a guiding sleeve 28 rigidly secured therein by means of webs 29 extending radially outward in four directions and being rigidly secured to the intersections of the various pipes defining the lattice slot in which the sleeve is located. As seen in FIG. 1, these six guiding sleeves 28 extend downwardly from the plane containing pipes 19, 20, 21 and 22 and initially support the template 10 on the floor 14 when it is landed. Each sleeve has elliptical orifices 30 formed therein.

As seen in FIG. 2, two hubs 31 and 32 are pivotally connected in passageways in pipe 19 and two other opposed hubs 33 and 34 are similarly pivotally connected in passageways in pipe 20.

Figure 6:
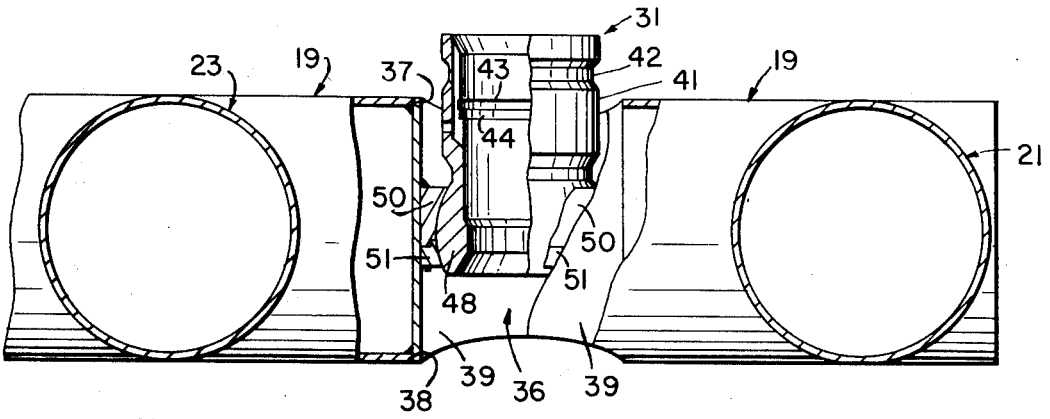
FIG. 6 is a front elevational view in section taken along lines 6—6 in FIG. 2 showing the hub and the pivotal connection to the template also illustrated in FIG. 5.

As seen in FIGS. 5 and 6 and regarding hub 31, a passageway 36 is formed in the template pipe 19 by cutting two coaxial apertures 37 and 38 in the top and bottom of the pipe 19 and welding a short sleeve 39 to the pipe so that the ends of the sleeve reside in the peripheries of the apertures 37 and 38. In top plan view, each of the apertures will appear as a circle but the actual configuration of the periphery of each aperture is somewhat like a saddle and the ends of the sleeve 39 are configured to conform with such saddle-shaped peripheries. Thus, while there are apertures formed in the pipes in the template, these apertures are essentially sealed by each sleeve to keep water out of the interior of the pipes forming the template as desired.

The hub 31 shown in FIGS. 5 and 6 comprises a tube 41 with an external annular groove 42 formed thereon adjacent the top of the hub and with two internal annular grooves 43 and 44 formed therein below external groove 42, each of these internal grooves having an outwardly and upwardly tapered lower wall 45 for groove 43 and 46 for groove 44. Below these grooves, there is an external annular groove 47 formed in the outside of tube 41, the bottom of which extends into an enlarged ball portion 48 in the form of a part of a sphere, this position 48 forming the male part of a ball joint to pivotally connect in a universal fashion the hub 31 to the template 10. Below groove 47 is an internal annular stop shoulder 49.

The female or socket part of this ball joint is formed, as seen in FIG. 5, by an upper ring 50 welded to sleeve 39 and a lower ring 51 connected by bolts 52 to the bottom of the upper ring 50. In combination, the internal surfaces of the upper and lower rings 50 and 51 form essentially two frustoconical facing surfaces separated by a substantially cylindrical surface, all of which approximates a portion of a spherical cavity or housing for pivotally receiving the enlarged ball portion 48 of hub 31.

Advantageously, the template pipes forming the lattice can be 30 inches in diameter, the support sleeves 39 can be 24 inches in diameter and the casing piles $8\frac{5}{8}$ inches in diameter.

As will be described in more detail hereinafter, four casing piles 12 will be utilized to support template 10 shown in FIG. 2, each of these piles being received in one of the hubs 31-34.

GRIPPING ASSEMBLY

Figure 7:
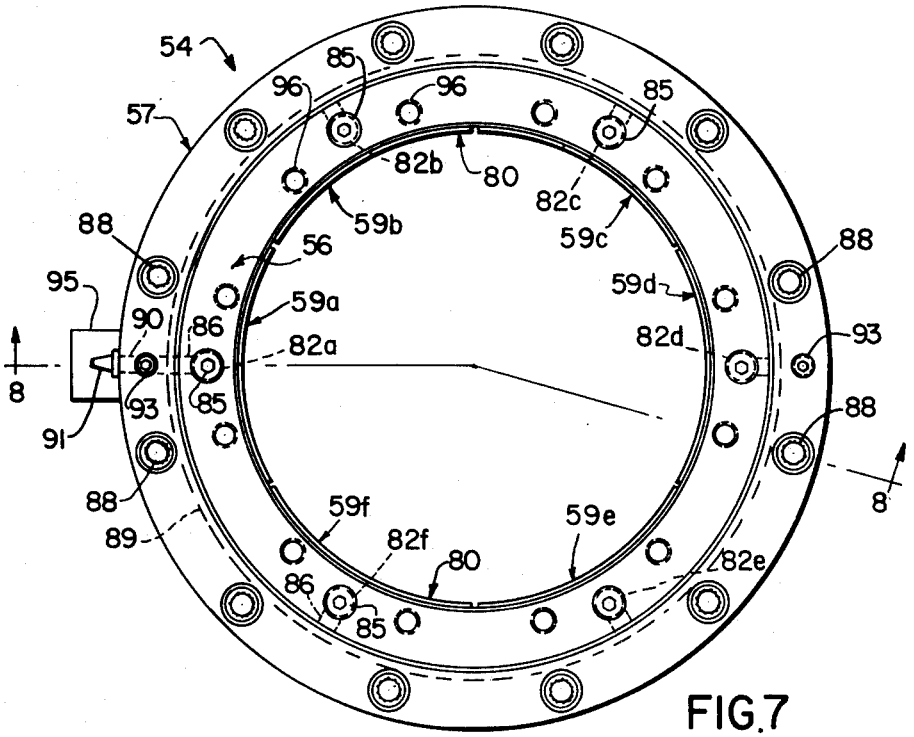
FIG. 7 is a top plan view of the pile gripping assembly shown in FIG. 5.
Figure 8:
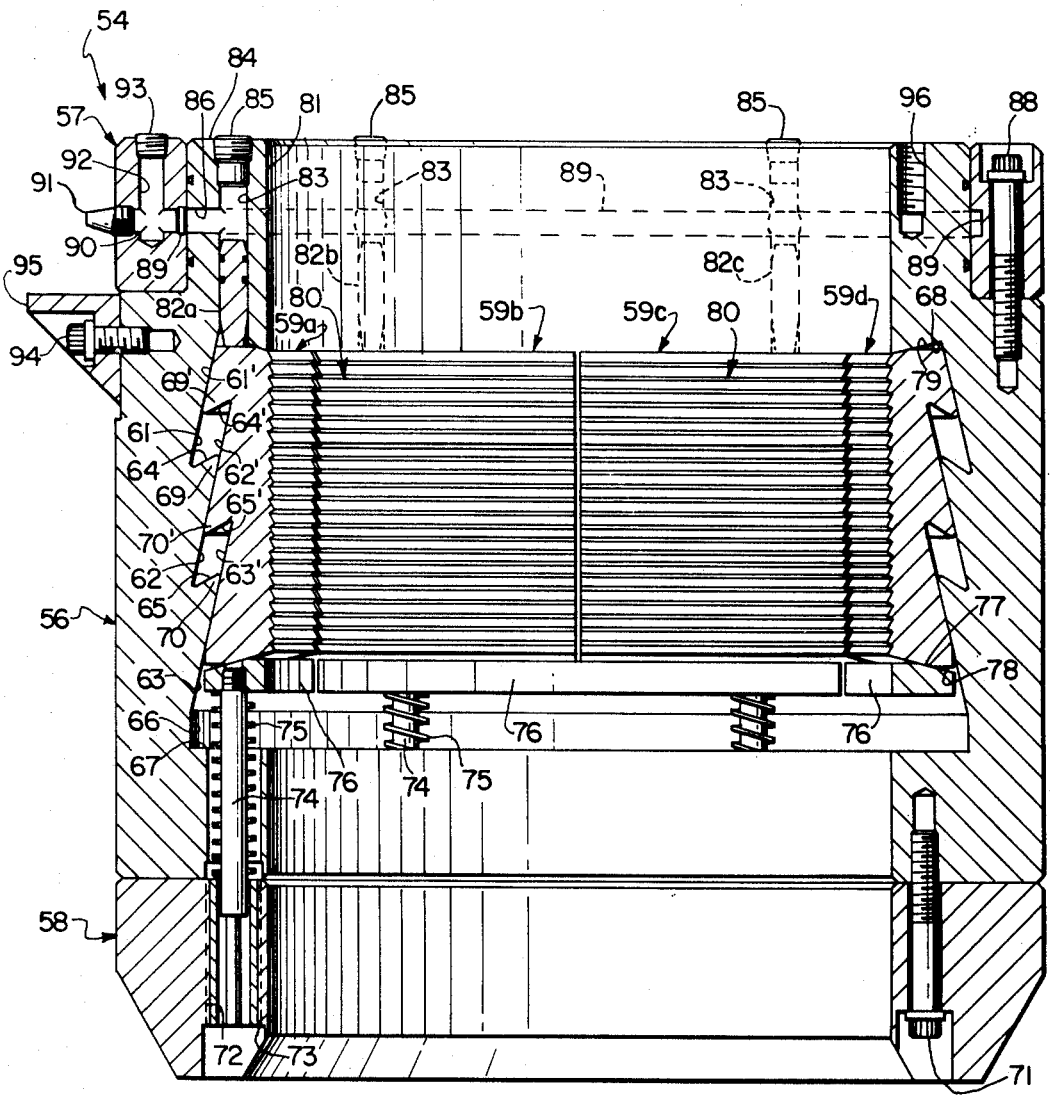
FIG. 8 is a side elevational view in section taken along lines 8—8 in FIG. 7 of the gripping assembly also shown in FIG. 5, the slips or ring segments being shown in the pile gripping or locked position.
Figure 9:
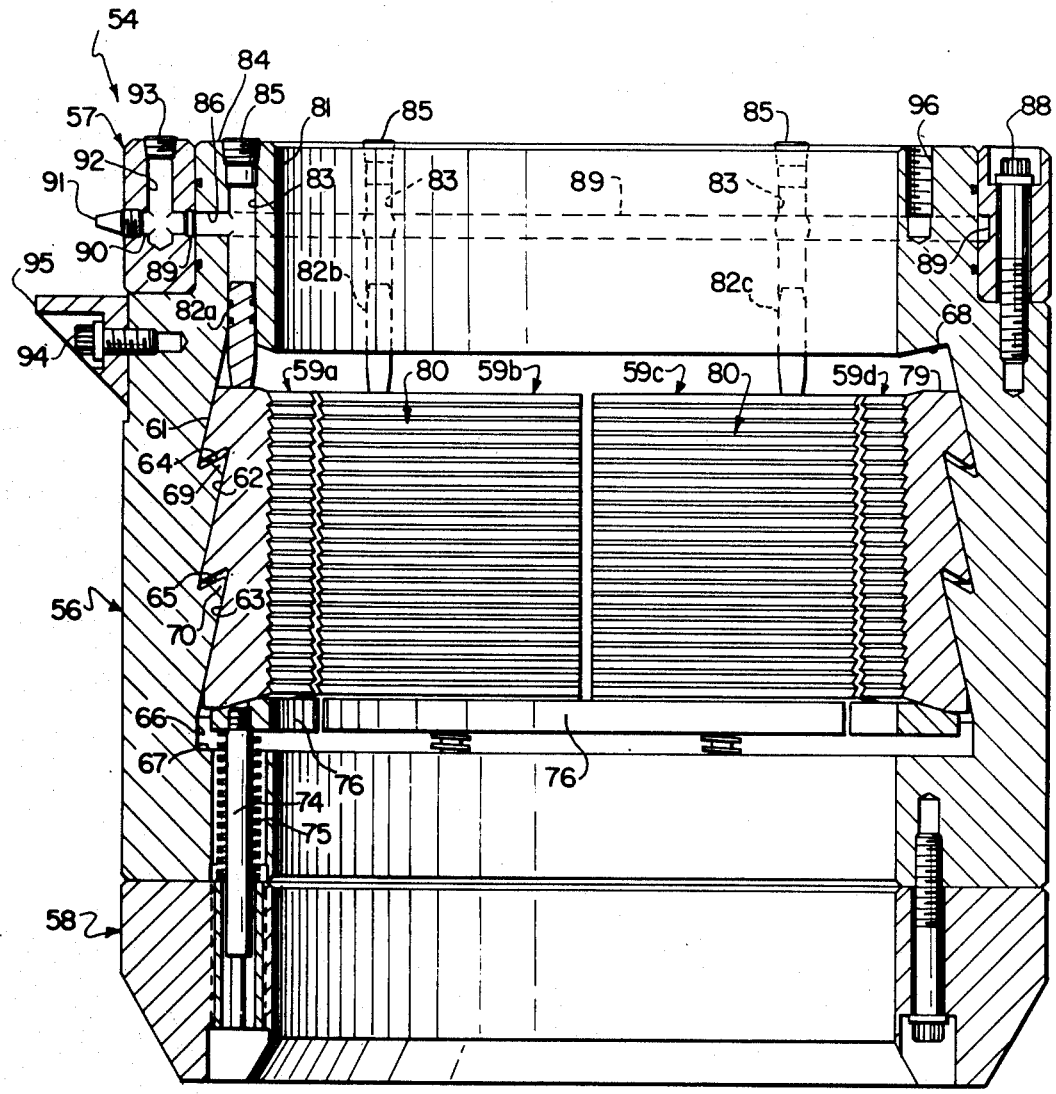
FIG. 9 is a side elevational view in section similar to that shown in FIG. 8 except that the slips or ring segments have been moved downwardly and outwardly into an unlocking or pile releasing position.

To ultimately support the template 10 in a level position on piles 12, each hub is provided with a gripping assembly 54 generally seen in FIG. 5 and shown in detail in FIGS. 7–9. Each of these gripping assemblies is rigidly secured inside each of the hubs and releasably receives one of the casing piles therein.

As seen in FIGS. 7, 8 and 9, the gripping assembly 54 is comprised of an annular member 56, an upper ring 57, a lower ring 58 and six ring segments or ball slips 59*a–f*.

On the internal side of annular member 56, which is also commonly called a slips bowl, are three upwardly and inwardly tapered frustoconical surfaces 61, 62 and 63 being joined by two shorter upwardly and inwardly tapered frustoconical surfaces 64 and 65 which taper at a larger angle. These surfaces 64 and 65 face generally upward. Frustoconical surface 63 extends downwardly into a radially facing annular surface 66 which extends downwardly into an upwardly facing annular shoulder 67. Frustoconical surface 61 extends into a downwardly facing, downwardly and inwardly tapered frustoconical surface 68.

As seen best in FIG. 8, frustoconical surfaces 62 and 64 define a rib 69 and frustoconical surfaces 63 and 65 define a second rib 70.

As seen in FIG. 8, the lower ring 58 is secured to the bottom of annular member 56 by means of a plurality of bolts 71 and has six circumferentially spaced threaded bores 72 (only one being shown), each of these threaded bores receiving an externally threaded tube 73 which in turn receives a rod 74 slidably therein. Each rod 74 is surrounded by a compression spring 75 which is compressed between the top of threaded tube 73 and the bottom of three thin ring segments 76, each of these segments being rigidly coupled to the top of two of the rods 74 by means of external threads on the rods and two internally threaded bores in the segments. The springs provide a preload to the segments, this being adjusted by rotation of tubes 73.

The tops of each of the three ring segments 76 have inwardly and upwardly tapered frustoconical surfaces 77 which support the bottoms of the six ball slips or ring segments 59*a–f*, which bottoms are in the form of corresponding upwardly and inwardly tapered frustoconical surfaces 78. Two ball slips are supported by one thin ring segment 76.

At the top of each of the ring segments 59*a–f* is a downwardly and inwardly tapered frustoconical surface 79 which mates with downwardly facing frustoconical surface 68 in annular member 56. As is apparent from FIGS. 8 and 9, surface 68 on annular member 56 and surfaces 79 on ring segments 59*a–f*, as well as surfaces 78 on ring segments 59*a–f* and surfaces 77 on thin ring segments 76 retain the ring segments 59*a–f* in the annular member 56, with compression springs 75 inherently biasing, and therefore preloading, the ring segments 59*a–f* upwardly and inwardly into a pile gripping or locked position shown in FIG. 8.

As is evident from FIG. 8, the ring segments 59*a–f* have on their external surfaces three upwardly and inwardly frustoconical surfaces 61', 62' and 63' joined by two shorter upwardly and inwardly frustoconical surfaces 64' and 65' which define two external ribs 69' and 70', corresponding to the surfaces and ribs on the interior of the annular member 56. These various surfaces and ribs are in slidable engagement so that the ring segments 59*a–f* can move upwardly and inwardly into the locking position and downwardly and outwardly into an unlocking position.

On the internal surface of each of the ring segments 59*a–f* are serrations 80 for gripping a casing pile 12 received within the segments.

As seen in FIG. 8, the segments 59*a–f* are in the casing pile gripping or locked position with the serrations extending inwardly of the internal bore 81 of annular member 56. In FIG. 9, the segments 59*a–f* are in the ungripping or unlocked position, the serrations 80 being radially exterior of the internal bore 81 in annular member 56.

This unlocking is accomplished by means of six pistons 82*a–f*, each of which acts downwardly on the top of each of the segments, the position of all of these pistons being generally indicated in FIG. 7. These pistons are insufficiently powerful by themselves to disengage the segments from the casing pile if more than a negligible load is being carried from the pile to the slips to the annular member 56. It is therefore necessary to unload that connection or induce free one-way motion of the pile relative to the segments prior to actuating the pistons.

Each of these pistons 82*a–f* is slidably received in one of six vertical bores 83, which are evenly circumferentially spaced around the annular member 56 above the center of each of the ring segments 59*a–f* and extend from the top surface 84 of the annular member vertically downwards through frustoconical surface 68 above segments 59*a–f*. Each of these vertical bores 83 is closed by a plug 85 suitably threaded into the top of each bore 83.

Extending radially outward in a horizontal direction from each of the vertical bores 83 is a horizontal bore 86 which opens to the exterior of the annular member 56.

The upper ring 57 is received in a reduced diameter slot 87 at the top of annular member 56 and is fastened thereto by means of bolts 88. Ring 57 has an internal groove 89 extending completely around the inside of ring 57 and vertically aligned and in communication with the six horizontal bores 86 extending outwardly from the six vertical bores 83 containing the six pistons 82*a–f* therein. Communicating with internal groove 89 is a horizontal bore 90 formed in ring 57 which is fluidly connected to a hydraulic male nipple 91. Extending downwardly from the top of ring 57 into communication with horizontal bore 90 is a vertical bore 92 closed at the top by a suitable plug 93. If desired, ring 57 could also be provided with a horizontal bore 90 and vertical bore 92 on the opposite side of the ring with an additional nipple being connected thereto.

Rigidly coupled by a bolt 94 to the outside surface of annular member 56 directly below nipple 91 is a key 95 which extends outwardly from member 56.

As seen in FIGS. 7, 8 and 9, a plurality of internally threaded blind bores 96 extend downwardly into the upper surface of annular member 56 for rigidly coupling an adaptor unit 97, seen in FIG. 5, to gripping assembly 54.

Referring now to FIG. 5, the adaptor unit 97 comprises an annular housing 100 having an internal flange 101 at its bottom, an external centrally located groove 102 and an external slot 103 at its top, the external groove receiving a plurality of outwardly sring biased locking segments 104 and the external slot receiving a releasing sleeve 105, releasably secured above the locking segments by means of a plurality of shear pins 106. The details of this adaptor unit 97 and its mode of operation are set forth in U.S. Pat. No. 3,240,511 to Bishop et al, the disclosure of which is hereby incorporated by reference. As seen in FIG. 5, a plurality of bolts 107 extend through suitable vertical bores in internal flange 101 and are threadedly received in internally threaded blind bores 96 in annular member 56 of the gripping assembly 54. This is also seen in FIGS. 10, 11 and 12.

As seen in FIG. 5, key 95 extending outwardly from the annular member 56 is aligned with a vertical internal slot 109 in hub 31 and, upon downward movement of the gripping assembly 54 key 95 will slide along slot 109 and stop slightly above bottom wall 110 of the slot. At the same time, the spring biased locking segments 104 will be received in groove 43 in hub 31 and the bottom part of annular housing 100 of adaptor unit 97 will be received in groove 44 in hub 31. The tapered bottom 60 of lower ring 58 will be received on internal shoulder 49 of hub 31.

Figure 11:
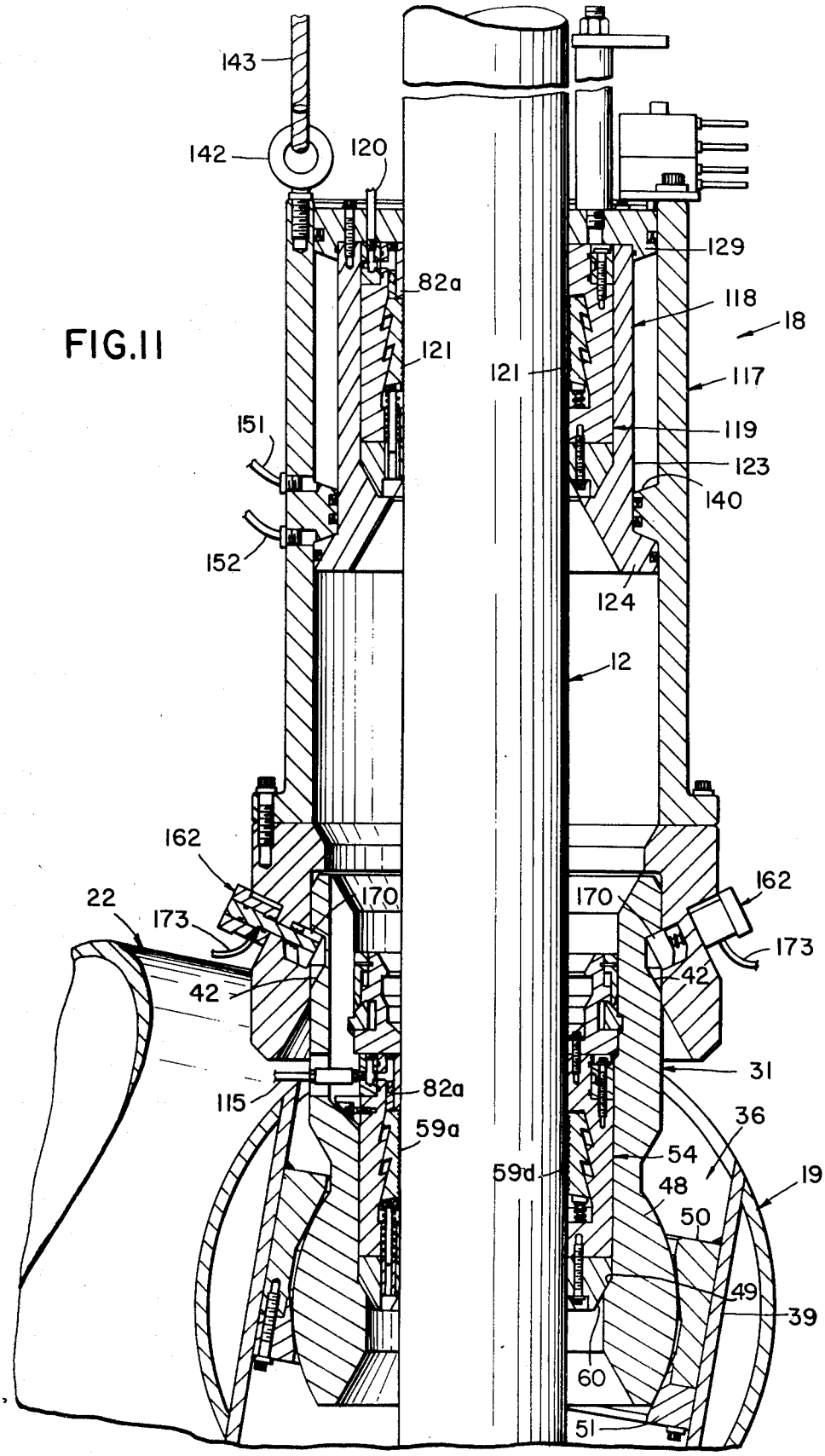
FIG. 11 is a side elevational view in section similar to that shown in FIG. 10 except that the jacking assembly has been fully landed and connected to the hub on the template.
Figure 12:
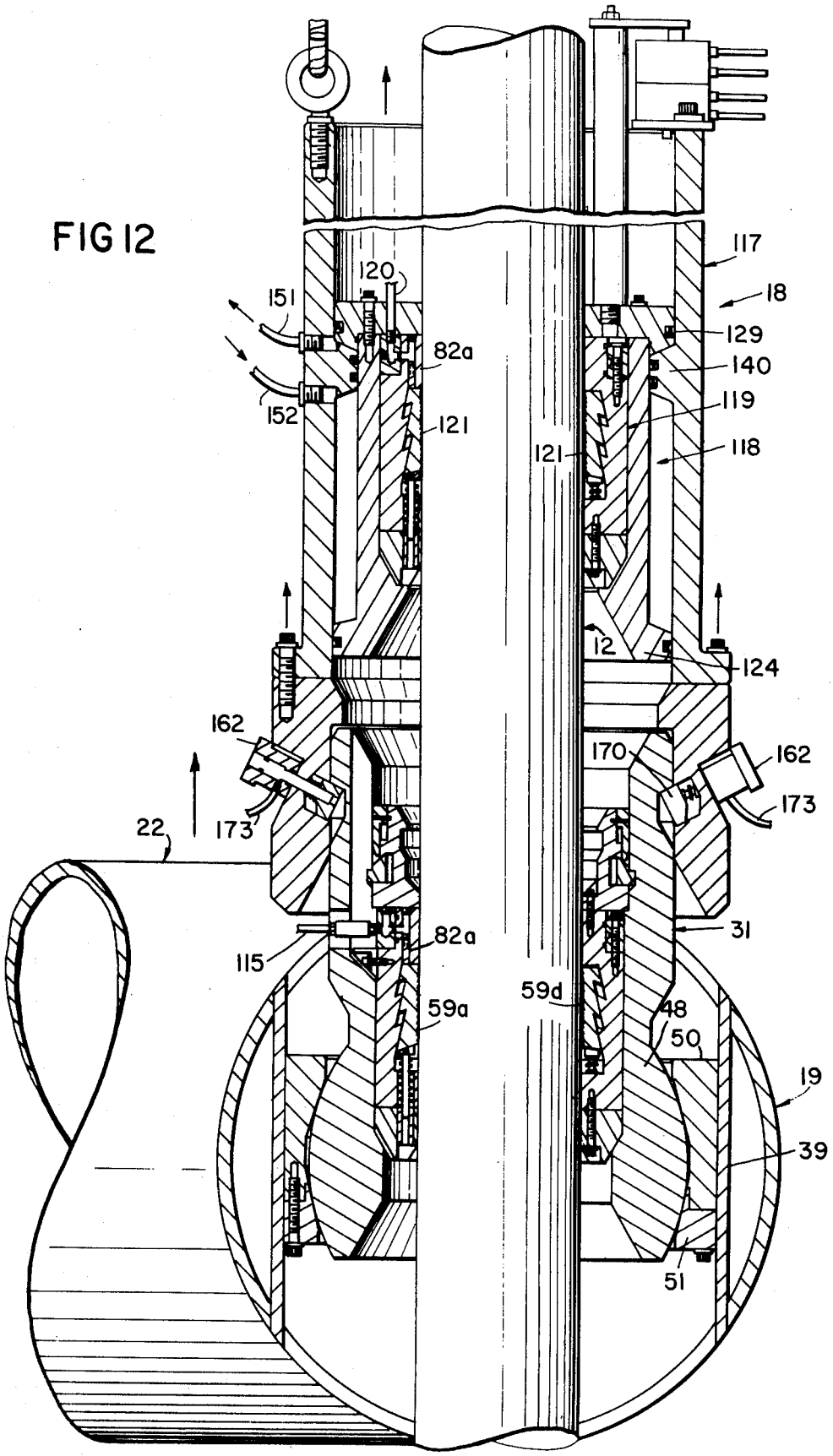
FIG. 12 is a side elevational view in section similar to that shown in FIG. 11 except that the jacking assembly has been activated to raise the template and the hub connected thereto upwards relative to the pile through one complete stroke.

This landed condition is shown in FIGS. 10 and 11 with the adaptor unit 97 being rigidly secured to the hub 31. As is evident from FIG. 10, the locking segments 104 can be biased inwardly of annular housing 100 by means of downward movement of releasing sleeve 105 which would sever shear pins 106. This can be accomplished by maneuvering a tool down on top of releasing sleeve 105 to release and retrieve the gripping assembly 54 in case of failure or maintenance requirements.

As seen in FIG. 10, when the gripping assembly 54 is fully landed in hub 31, the male nipple 91 is horizontally aligned with bore 112 in hub 31 which communicates with slot 109. This allows a hydraulic connecting device 114 to be maneuvered through bore 112 into a coupling with the male nipple 91. Extending from the connecting device 114 is a hydraulic line 115. This hydraulic line would be connected via connecting device 114 to male nipple 91 by a diver after the gripping assembly 54 is landed in hub 31.

JACKING ASSEMBLY

As seen in FIG. 10, the jacking assembly 18 is moving downwardly on the casing pile 12 and is about to be landed on hub 31.

The jacking assembly 18 is comprised of an annular open ended housing 117, a double acting hydraulic piston 118 slidably received inside the housing, and a second gripping assembly 119.

This second gripping assembly 119 is formed and operates almost exactly as does the first gripping assembly 54 except that no adaptor unit is used with it so that threaded bores 96 used to couple the adaptor unit to the gripping assembly are not used, the key 95 and connecting bolt 94 are eliminated, horizontal bore 90 is plugged while vertical bore 92 is not plugged but is connected to a hydraulic line 120. The ring segments, or jack slips, for the second gripping assembly 119 are each designated by the reference numeral 121, there being six of these jack slips as there were six of the ball slips 59*a–f*.

The double acting hydraulic piston 118 is formed from an annular member 123 having an external flange 124 at the bottom in slidable engagement with the interior surface 125 of the annular housing 117 and having an inwardly and downwardly frustoconical interior surface 126 receiving the bottom of the second gripping assembly 119 therein. To enclose the second gripping assembly 119 in annular member 123 there is a circular plate 127 rigidly connected via bolts 128 to the top of annular member 123. This plate 127 has an external flange 129 extending past annular member 123 and slightly down below the top of that member and is in slidable engagement with the interior surface 125 of annular housing 117. The hydraulic line 120 passes upwardly through the plate 127 via vertical bore 130. A threaded bore 131 in the plate 127 receives the threaded end of a rod 132 which has a plate 133 rigidly coupled at the top thereof perpendicular to the longitudinal axis of the rod. A central aperture 134 is formed in plate 127 to receive the casing pile 12 therein. As seen in FIG. 10, this casing pile 12 also extends through the second gripping assembly 119 and can be gripped or released by ring segments, or jack slips, 121.

Rigidly coupled to the top of annular housing 117 are two position indicating valves 136 and 137, these valves having, respectively, external push buttons 138 and 139 and being used only in lowering the template. As seen in FIG. 10, push button 138 on valve 136 is upwardly facing and can be depressed upon downward movement of plate 133 coupled to rod 132 and in turn the piston 118. On the other hand, push button 139 in valve 137 is downwardly facing and can be actuated by contact with plate 127 in piston 118 upon upward movement of slightly less than the full stroke of piston 118. Plate 133 will contact the other push button 138 upon downward movement of slightly less than the full downward or retracting stroke of piston 118.

This stroke and the slidable movement of piston 118 inside housing 117 is determined and limited by an internal flange 140 extending inwardly from the internal surface 125 of housing 117. Thus, as seen in FIG. 10, flanges 124 and 129 on opposite ends of piston 118 are on opposite sides of the internal flange 140.

Advantageously, the piston stroke is 12 inches and displaces 3.46 gallons, the piston area is 66.7 square inches, the working pressure is 1500 psi, and the piston load is 100,000 pounds.

To lower and retrieve the jacking assembly 18 on casing pile 12, a plurality of eye bolts 142 are suitably threaded into suitable bores in the top of annular housing 117 and connected to lowering lines 143.

Suitably connected to position indicating valve 136 are two hydraulic lines 145 and 146 and suitably connected to the other position indicating valve 137 are two other hydraulic lines 148 and 149.

Two additional hydraulic lines 151 and 152 are suitably connected to annular housing 117 and can deliver hydraulic fluid via bores 154 and 155 respectively into the interior of annular housing 117, hydraulic line 151 delivering the fluid above internal flange 140 to upwardly extend piston 118 and hydraulic line 152 delivering hydraulic fluid below flange 140 to retract or move the hydraulic piston 118 downwardly.

At the bottom of housing 117 there is an external flange 157 having suitable bores therein to receive a plurality of bolts 158 to rigidly couple an annular connector housing 159 to annular housing 117. The connector housing 159 has an external groove 160 and an internal groove 161. A plurality of releasable connecting devices 162 are mounted in grooves 160 and 161 and pass through a plurality of bores 163 interconnecting these grooves. Each connecting device 162 comprises a block 164 having a large bore 165 extending therein from one side, a smaller coaxial bore 166 extending from the large bore to the other side, and a transverse port 167 extending from the outside of the block into the small bore adjacent the interface with the large bore. A piston 168 is received in the large bore 165 and has a smaller diameter shaft 169 extending therefrom through the small bore 166, through bore 163 in connector housing 159 and into a threaded engagement with a locking dog 170. A coiled compression spring 171 is interposed between the locking dog 170 and the bottom wall of groove 161. A hydraulic line 173 is suitably coupled to port 167 to deliver hydraulic fluid against piston 168 to withdraw locking dog 170 outwards. This releases the locking dog 170 from the external groove 42 on hub 31 as seen in FIGS. 10 and 11. Coiled spring 172 will bias locking dog 170 inward of housing 159 into the locking position with groove 42 in hub 31.

MECHANICAL INSTALLATION AND LEVELLING OPERATION

Referring now to FIGS. 1, 3, 4, 5, 10, 11 and 12, the installation and levelling steps are shown for template 10.

As seen in FIG. 1, the first step is lowering the template 10 through the water 16 and then landing the template on the floor 14 of the body of water. This is advantageously accomplished by connecting the template to guidelines 175 and lowering these lines from a vessel 177 located at the water level 178. As shown diagramatically in FIG. 1, the template 10 is lowered with hubs 31–34 already pivotally coupled thereto, but as seen in FIG. 5 without the gripping assemblies 54 received in the hubs. Instead, bore protectors are pre-installed in the hubs. Drilling guide funnels are also pre-installed on the hubs, although both could be remotely installed.

Next in the installation sequence, a drill string and drilling bit is lowered down from vessel 177 and advantageously guided by guidelines 175 through each of the bore protectors in each of the hubs 31–34 and into the floor of the body of water to drill out bores for the casing piles. During this drilling operation, the hubs 31–34 are aligned to a true vertical orientation so that the drilling string drills vertical bores for the casing piles.

When the drilling operation is completed, the drilling string is retrieved. The bore protector and hubs are thoroughly washed and the bore protector is retrieved using a conventional handling tool. The washing procedure is repeated.

Then, the gripping assemblies 54 are lowered through the water and landed in each of the hubs, once again using a conventional handling tool. As seen in FIG. 5, the gripping assembly 54 is being lowered into hub 31, the final landing of the gripping assembly relative to the hub being shown in FIG. 10.

Figure 3:
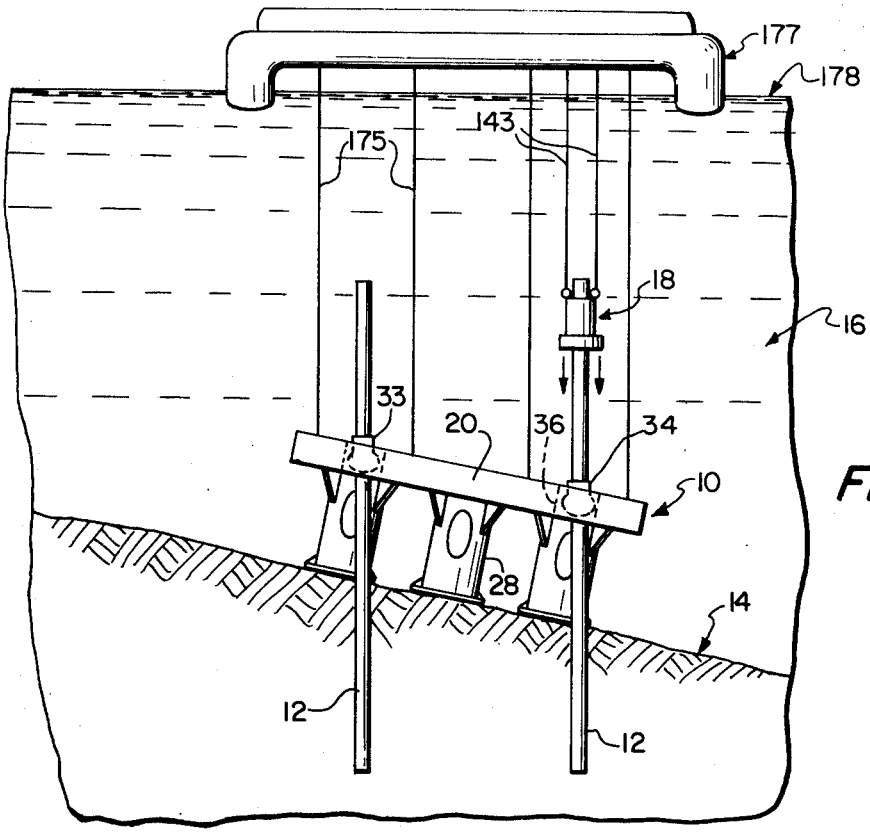
FIG. 3 is a diagramatic representation similar to that shown in FIG. 1 except that casing piles have been implanted in the floor of the body of water, have passed through passageways in the template and have portions extending above the template with the retrievable jacking assembly being lowered from the vessel along one of the piles.

Once the gripping assemblies are completely landed, the casing piles are lowered through the water and are passed into the gripping assemblies and into the bores in the floor of the body of water, with portions of the casing piles extending above the gripping assemblies in the hubs as shown in FIGS. 3 and 10. At this time, cement can be run down the inside of the casing piles 12 to rigidly secure them to the floor 14 of the body of water. Advantageously, the step of lowering the casing piles can include guiding the piles with guidelines 175.

Once the cementing operation is complete, the drilling guide funnels can be retrieved by a handling tool.

The template can now be raised and lowered relative to the fixed casing piles and locked in place on them in a levelled, true horizontal, which is perpendicular to the radius of the earth.

Figure 4:
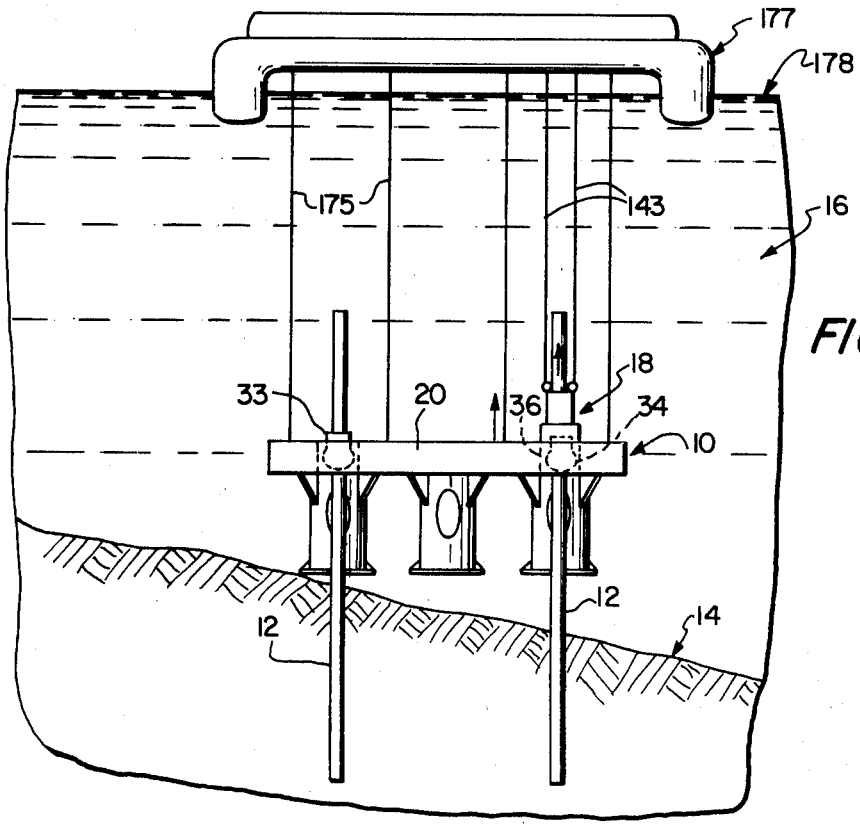
FIG. 4 is a diagramatic representation similar to that shown in FIG. 3 except that the jacking assembly has been connected to the template adjacent the pile upon which it is lowered and has moved up that casing pile, thereby raising the template with it into a level position.

This is accomplished by lowering the jacking assembly 18 over each of the casing piles 12 via lowering lines 143, as seen in FIGS. 4 and 10, and connecting the jacking assembly 18 to each of the hubs, as seen in FIG. 11. The jack slips 121 are unlocked, or in the released position, when the jacking assembly is run down the pile. It is also preferable to fully extend the piston 118 upwardly to the top of housing 117 and unlock connectors 162 prior to stabbing the jacking assembly over the pile.

Advantageously, one jacking assembly 18 can be utilized to level the template 10 by being maneuvered one by one onto each of the casing piles and raising or lowering the template adjacent that pile until the entire template is levelled. On the other hand, a plurality of jacking assemblies can be utilized together or in series. This levelling operation which moves the template from its inclined position seen in FIGS. 3 and 11, is accomplished by coordinating the locking and unlocking of the jack slips 121 in the second gripping assembly 119 in the jacking assembly 18, the locking and unlocking of the ball slips 59*a–f* in the first gripping assembly 54 coupled to hub 31, and movement of the annular housing 117 of the jacking assembly relative to the piston 118.

As seen in FIG. 11, the ball slips 59*a–f* can be moved downwardly from the locking position into the unlocking position by activation of pistons 82*a–f* via hydraulic line 115 and similarly the jack slips 121 can be moved downwardly by actuation of pistons 82*a–f* by means of hydraulic line 120. In addition, the double acting piston 118 can be moved upwardly or extended by conducting hydraulic fluid via hydraulic line 151 between flange 129 on piston 118 and flange 140 on housing 117. On the other hand, the piston 118 can be lowered or retracted by means of hydraulic fluid conducted via hydraulic line 152 into housing 117 between flange 140 on the housing and lower flange 124 on piston 118.

MECHANICAL OPERATION TO RAISE THE TEMPLATE

As seen in FIG. 11, the jacking assembly 18 is coupled to hub 31; piston 118 is upwardly extended with flanges 124 and 140 abutting and jack slips 121 locked; and the template 10 is inclined with the ball slips locked. To raise that part of the template 10 adjacent hub 31 to level the template, the jack slips 121 must remain locked, which they automatically do because of the spring preload, while the ball slips need not be positively unlocked, since upward movement of hub 31 allows the ball slips to slide downwardly and outwardly into an ungripping position without control intervention. In this FIG. 11 condition, hydraulic fluid enters housing 117 via line 152 and pushes housing 117 upwardly relative to fixed piston 118, acting between flanges 140 on the housing and 124 on the piston. The upward movement of the housing 117 carries with it the hub 31 and pipe 19 in template 10 connected to the hub 31. At the same time, hub 31 pivots relative to pipe 19.

As seen in FIG. 12, housing 117 has moved a full stroke upwards relative to fixed piston 118 with housing flange 140 abutting piston flange 129. In FIG. 12, this full stroke, by way of example, has essentially levelled the template since pipe 22 on the template is shown horizontal. If further upward movement of the template is necessary, the piston 118 is first moved upwards relative to housing 117 by supplying hydraulic fluid via line 151 between flanges 129 and 140. This would move piston 118 from the position shown in FIG. 12 back to that shown in FIG. 11. Then the cycle described above using hydraulic lines 152 is repeated. To move the piston upwards, the jack slips need not be positively unlocked since upward movement allows the slips to slide downwardly and outwardly into an ungripping position without control intervention. When the desired height for the template is reached, the piston 118 is moved upwards for a full stroke. This ensures that the template weight is resting fully on the ball slips in the hub. Then the connectors 162 are released and the jacking assembly is lifted straight up and off the pile.

MECHANICAL OPERATION TO LOWER THE TEMPLATE

Referring now to FIGS. 13–16, a diagramatic representation is shown for the movement of the template 10 downwardly. This requires the alternate unlocking of the jack slips and the ball slips and alternating relative movement of the piston 118 and the housing 117. To unlock the jack slips, hydraulic fluid via line 120 acts on pistons 82*a–f* in gripping assembly 119, moving them downwardly. To unlock the ball slips, hydraulic fluid via line 115 acts on pistons 82*a–f* in gripping assembly 54, moving them downwardly.

Figure 13:
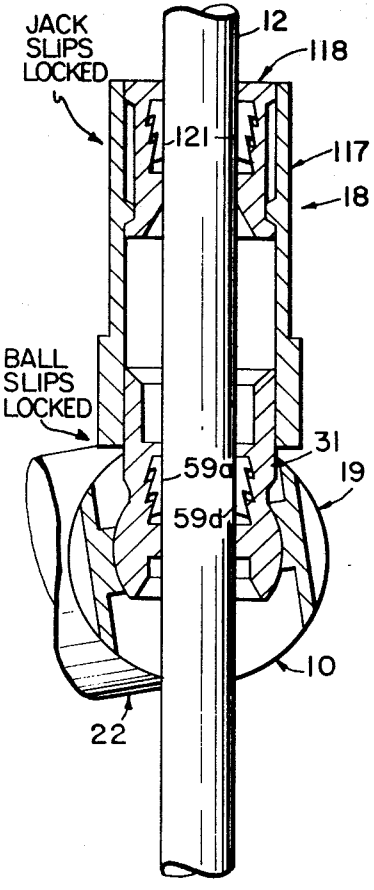
FIG. 13 is a diagramatic representation of the apparatus shown in detail in FIG. 11 except the template is downwardly inclined, with the jacking assembly ring segments, or jack slips, in a locked position and with the hub ring segments, or ball slips, shown in a locked position.

Thus, as shown in FIG. 13, the jacking assembly 18 is connected to hub 31 with both the jack slips 121 and the ball slips 59*a–f* locked.

Figure 14:
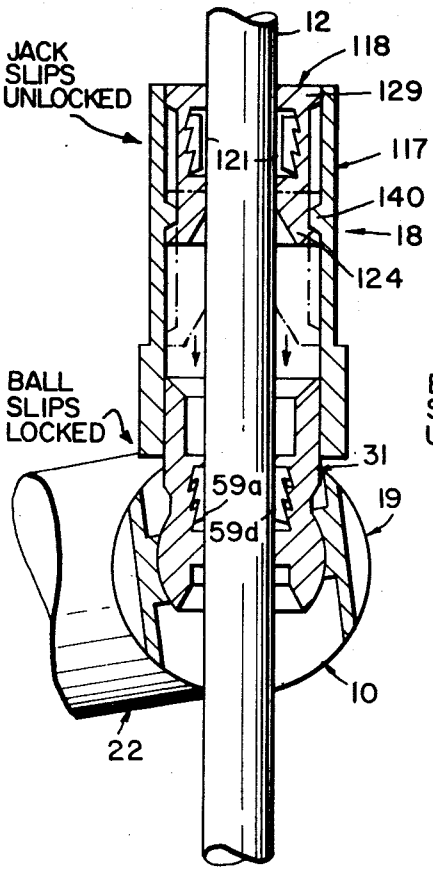
FIG. 14 is a diagramatic representation similar to that shown in FIG. 13 except that the jack slips have been moved into an unlocked position and the piston carrying the jack slips has moved downwardly a full stroke as shown in phantom.

To instigate downward movement of the area of template 10 adjacent casing pile 12 and jacking assembly 18, the jack slips 121 are unlocked as seen in FIG. 14, while the ball slips remain locked.

Figure 15:
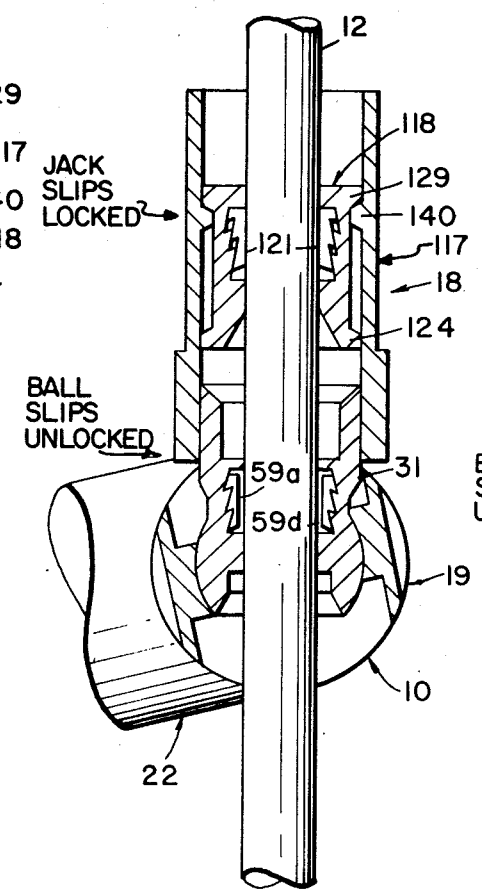
FIG. 15 is a diagramatic representation similar to that shown in FIG. 14 except that the jack slips have been locked and the ball slips unlocked.

Then, with the jack slips 121 still unlocked, hydraulic fluid is caused to enter annular housing 117 between flanges 140 on the housing and 124 on piston 118. Because the piston 118 is free to move relative to casing pile 12, the hydraulic fluid will force the piston 118 downwardly as seen in phantom in FIG. 14. Next, as seen in FIG. 15, the jack slips are locked and the ball slips are unlocked. Hydraulic fluid is next caused to enter housing 117 between flanges 129 and 140, thus moving housing 117, hub 31 and template 10 downwardly relative to fixed piston 118. As pipe 19 of the template 10 moves downwardly, the hub 31 will pivot relative to the pipe and ultimately, when the entire template is levelled, will be perpendicular to the plane containing the template.

Figure 16:
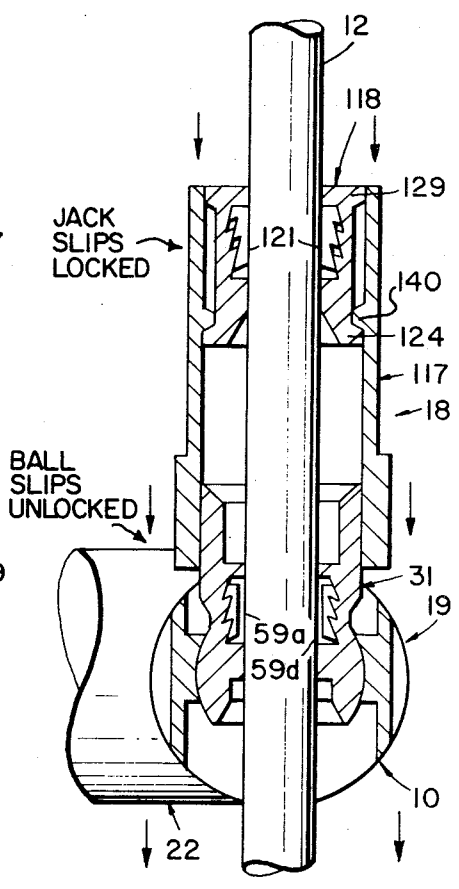
FIG. 16 is a diagramatic representation similar to that shown in FIG. 15 except that jacking assembly housing, hub and template have moved downwardly relative to the fixed piston supported by the jack slips to level the template.

After the levelled orientation shown in FIG. 16 is accomplished, the ball slips 59*a–f* are locked to grip the casing pile 12 relative to the hub 31 and thus the pipe 19 of the template.

As shown in FIGS. 13–16, a full stroke of the housing 117 relative to piston 118 was necessary to level the template. If more than one such stroke were required, first the full stroke would be accomplished by moving the annular housing 117 fully downward so that flange 140 abutted flange 124 on piston 118 as seen in FIG. 16. Then, the sequence illustrated in FIGS. 13–16 and described above would be repeated until the template were level.

HYDRAULIC CONTROL CIRCUIT AND OPERATION

Figure 17:
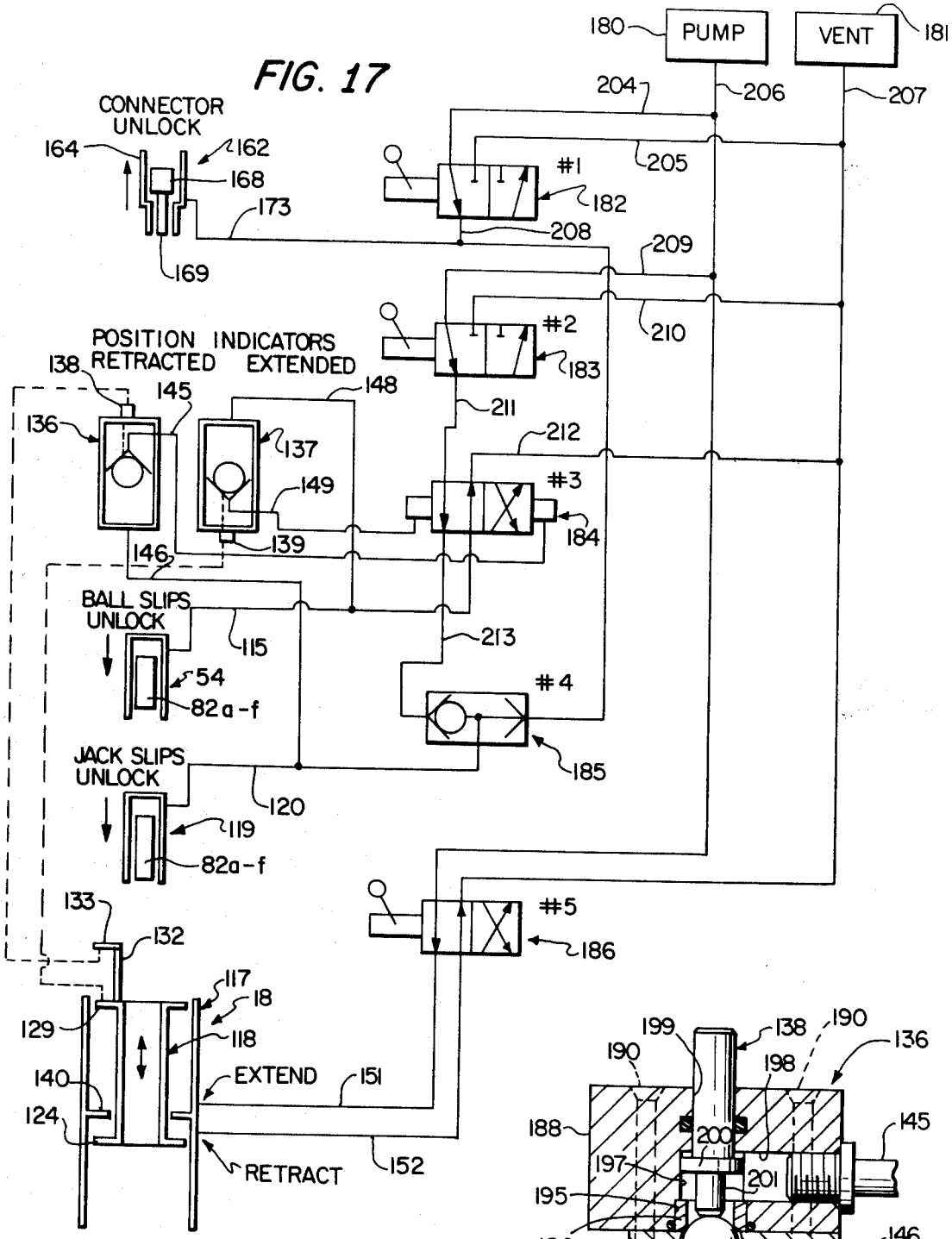
FIG. 17 is a schematic diagram of the hydraulic circuit used to control the system in accordance with the invention.

As seen in FIG. 17, a hydraulic circuit is shown for unlocking the connectors 162, unlocking the ball slips 59*a–f* in the first gripping assembly 54 via pistons 82*a–f*, unlocking the jack slips 121 in the second gripping assembly 119 in piston 118 via pistons 82*a–f* and extending or retracting the piston 118 relative to the annular housing 117 in the jacking assembly 18. This hydraulic circuit also includes the position indicator valves 136 and 137 with their push buttons 138 and 139 which are activated respectively by plate 133 coupled via rod 132 to piston 118 and the top of the piston itself and necessary only for lowering the template.

The hydraulic circuit includes a pump 180 for hydraulic fluid and a vent or reservoir 181 for the hydraulic fluid.

The hydraulic circuit also includes a first valve 182, a second valve 183, a third valve 184, a fourth valve 185, and a fifth valve 186. The first valve 182 is a three-way, two-position lever actuated valve advantageously mounted on a control panel for controlling the connector 162. The second valve 183 is a three-way, two position lever actuated valve which is also preferably mounted on a control panel for controlling the jacking up and down of the template with the lever being oriented as shown in FIG. 17 for jacking down and moved to the right for jacking up. The third valve 184 is a four-way, two-position, pilot pressure operated valve with a spring biased offset to alternately unlock the jack and ball slips in the jacking down mode and is detented in each of its two positions so that maintenance of a pilot pressure signal is not required to maintain the sense of the control. The fourth valve 185 is a positive shuttle valve, or double acting check valve, that allows unlocking of the jack slips. The fifth valve 186 is a four-way, two-position lever actuated valve preferably mounted on a control panel for extending and retracting the piston 118 relative to the annular housing 117.

Figure 18:
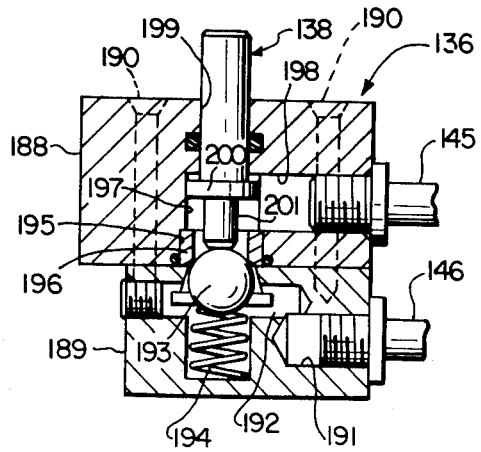
FIG. 18 is a longitudinal sectional view of a position indicating valve used in the hydraulic circuit.

As seen in FIG. 18, one of the position indicating valves is specifically shown in longitudinal cross-section. The valve 136 illustrated therein comprises a top half 188 and a bottom half 189 suitably coupled together by bolts 190. In the bottom half 189, hydraulic line 146 is suitably threadedly engaged with a horizontal port 191 which communicates with a cavity 192 having a ball 193 located therein and biased upwardly via spring 194. In the top half 188, a vertical bore 195 receives a ring 196 therein with a tapered inner surface forming a seat for ball 193. Coaxially above bore 195 is a smaller vertical bore 197 which communicates with horizontal port 198 which is suitably secured with hydraulic line 145. A vertical bore 199 extends upwardly from bore 197, has a smaller diameter, and receives the cylindrical push button 138 therein. The push button has an annular flange 200 having a diameter substantially equal to the inner diameter of bore 197 in which the flange is located. Below the flange 200 is a smaller diameter cylindrical extension 201 on the push button which can contact ball 193 and move it away from ring 196. Hydraulic fluid can flow from hydraulic line 146 through valve 136 and out via hydraulic line 145 only when the push button 138 is depressed.

Referring again to FIG. 17, hydraulic lines 204 and 205 connect the first valve 182 respectively with the pump and vent via hydraulic lines 206 and 207. The first valve 182 is connected via hydraulic line 208 to hydraulic line 173 which is also connected to the fourth hydraulic valve 185 and to connectors 162 connecting the jacking assembly 18 to the hubs 31–34.

The second valve 183 is connected via hydraulic lines 209 and 206 to the pump and via lines 210 and 207 to the vent. Valve 183 is also connected via hydraulic line 211 to the third valve 184. Pilot pressure is supplied to this third valve 184 via hydraulic lines 145 from position indicating valve 136 and line 149 from position indicating valve 137. The third valve 184 is connected to the vent via hydraulic line 212 and hydraulic line 207. Hydraulic line 115 connects pistons 82*a–f* in the ball slips to the third valve 184 and a hydraulic line 213 connects valve 184 with the fourth valve 185. This valve is also connected to the pistons 82*a–f* in the jack slips via hydraulic line 120 which is also connected to hydraulic line 146 in position indicating valve 136. Similarly, hydraulic line 148 from position indicating valve 137 is connected to hydraulic line 115.

The fifth valve 186 is connected to the pump via hydraulic line 206 and to the vent via line 207, this valve being connected via hydraulic lines 151 and 152 to deliver hydraulic fluid to provide relative movement between the double acting piston 118 and the annular housing 117 in the jacking assembly 18.

HYDRAULIC OPERATION TO RAISE THE TEMPLATE

With the jacking assembly 18 received over the hub 31 and piston 118 at the top of housing 117 as seen in FIGS. 11 and 17, the first valve 182 has its lever moved to the right as viewed in FIG. 17 to be sure that the connectors 162 are locked and also the second valve 183 has its lever moved to the right as viewed in FIG. 17 to be sure that the jack slips are locked. Then the lever in the fifth valve 186 is moved to the right as viewed in FIG. 17, thereby pressurizing hydraulic lines 206 and 152 with lines 151 and 207 being vented. This allows hydraulic fluid to move through hydraulic line 152 and raise the annular housing 117 upwardly relative to piston 118 which is locked on the casing pile so that the hub and attached template are raised. This raising motion will continue until the inner flange 140 on the housing contacts the upper flange 129 on the piston. Then the lever in the fifth valve 186 is moved to the left as shown in FIG. 17 to allow hydraulic lines 206 and 151 to be pressurized driving the piston 118 upwardly. This can happen without unlocking the jack slips since they automatically release upon upward movement. Similarly, this can occur without unlocking the ball slips since they too automatically release upon upward movement relative to the casing pile without being positively unlocked.

This cycle is repeated until that portion of the template adjacent the jacking assembly 18 is raised to the required level. At that time, valve 182 is activated, by moving the lever to the left as shown in FIG. 17, to unlock the jack slips and connectors and the jacking assembly 18 is lifted straight up off the pile and moved to the next pile.

HYDRAULIC OPERATION TO LOWER THE TEMPLATE

To lower the template with the piston 118 at the top of housing 117 as seen in FIGS. 11, 13 and 17, the first valve 182 has its lever moved to the right as viewed in FIG. 17 to maintain the connectors locked, the second valve 183 has its lever in the position shown in FIG. 17 and the fifth valve 186 has its lever moved to the right as viewed in FIG. 17. This allows pressurized hydraulic fluid to move along hydraulic lines 206 and 152 through valve 186 and drive the piston 118 downwardly relative to the housing 117 since at the same time pressurized hydraulic fluid flows along hydraulic lines 206 and 209 through the second valve 183 along hydraulic line 211 and 213 and then through the fourth valve 185 and from there along line 120 to unlock the jack slips.

As the final approimately quarter-inch of the downward stroke of the piston is entered, plate 133 on rod 132 connected to piston 118 pushes down push button 138 on position indicating valve 136 (thus opening this valve), which in turn locks the jack slips and applies an unlocking pressure to the ball slips. This is accomplished by the opening of valve 136 which allow pressurized hydraulic fluid to flow out thereof along hydraulic line 145 and deliver a pilot pressure to the third valve 184. The hydraulic fluid initially flowing to valve 136 comes frm valve 185, and lines 120 and 146. The pilot pressure moves the third valve so that pressurized hydraulic fluid moves from line 211 through valve 184 and along line 115 to unlock the ball slips by pressurizing pistons 82*a–f*. At the same time, this movement in valve 184 allows lines 120, 213, 212 and 207 to be opened to the vent thereby locking the jack slips. Lines 145 and 146 also are opened to the vent.

As this occurs, the jack slips will grip the casing pile and the remaining fraction of an inch of stroke moves the housing up relative to the piston to raise the template and the ball slips, allowing these ball slips to unlock under pressure from pistons 82*a–f*.

At this time, the fifth valve 186 has its lever moved from the right to the left as seen in FIG. 17 and hydraulic fluid is vented along hydraulic lines 152 and 207. This allows the template to descend. As the final approximately quarter-inch of the stroke is entered, the other position indicating valve 137, which is carried by annular housing 117 moving downwardly with the template, has its push button 139 pushed by fixed piston 118, which results in locking of the ball slips and applying unlocking pressure to the jack slips. This is accomplished by the opening of valve 137 and by allowing pressurized fluid to flow to valve 137 via lines 148 and 115 from valve 184 and from valve 137 along hydraulic line 149 to the third valve 184 to apply pilot pressure and move it into the position shown in FIG. 17, thereby venting hydraulic line 115, as well as lines 148, and 149, via lines 212 and 207 to lock the ball slips. This also unlocks the jack slips by allowing pressurized hydraulic fluid to flow along lines 206, 209, 211, 213 and 120 to act on the pistons 82*a–f* in the jack slips.

As this occurs, the ball slips will grip the pile and the remaining fraction of an inch of the stroke will raise the jack slips, allowing them to unlock under pressure from the pistons.

This cycle is repeated as required to lower the template to the desired height.

RADIAL FREE PLAY EMBODIMENT OF FIG. 19

To eliminate the potential deflection of the casing piles during levelling of the template by means of the jacking assembly, radial free play is built into the system between the casing pile and the double acting piston, and between the casing pile and the hub coupled to the template as well as the adaptor unit coupling the ball slips to the hub.

Figure 19:
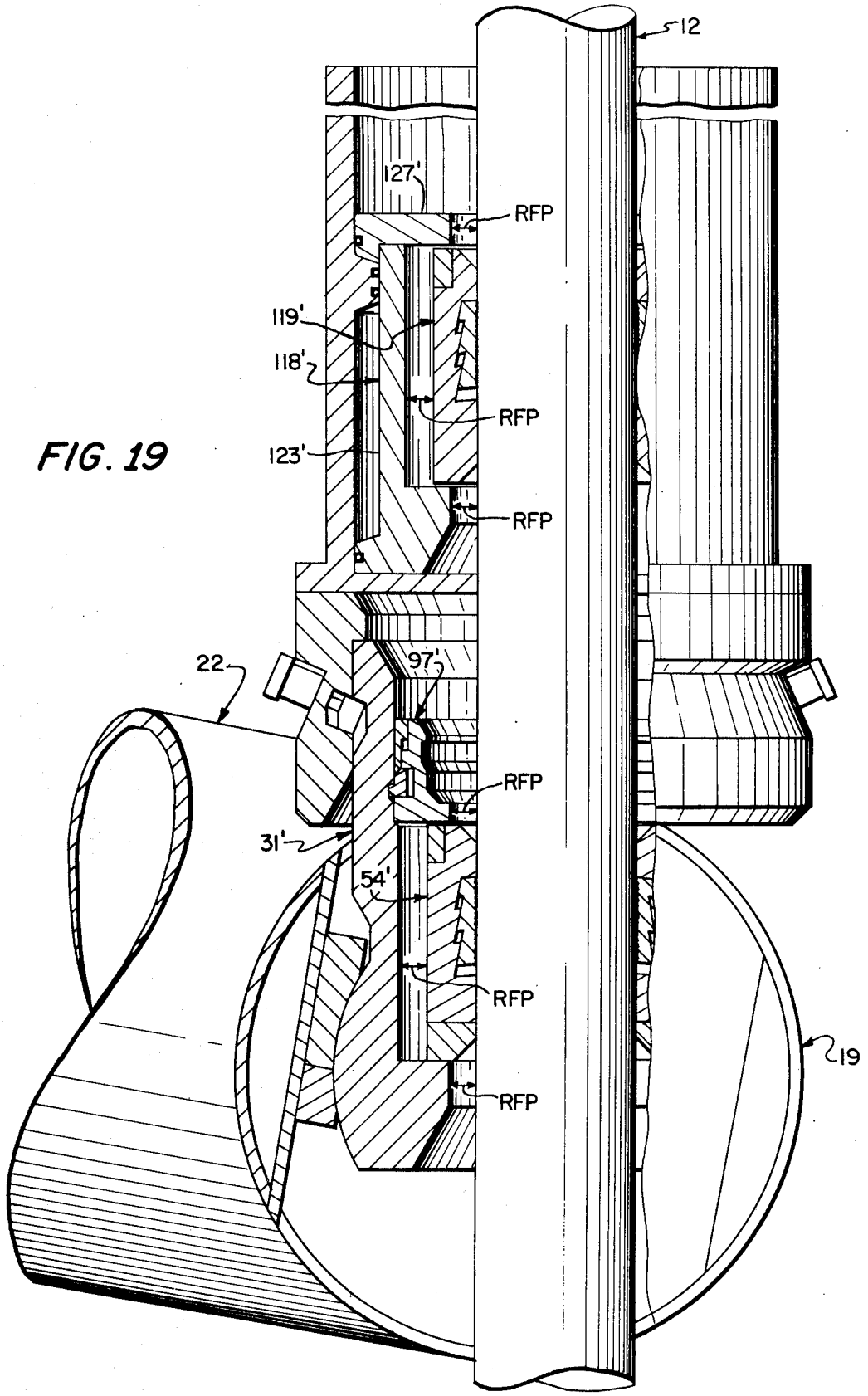
FIG. 19 is a side elevational view in partial section similar to that shown in FIG. 11 except that a modified configuration is used for the gripping assemblies in the hub and the jacking assembly to provide radial free play between the pile and the hub and jacking assembly to eliminate potential deflection of the pile during the levelling operation and with some details removed for clarity.
Figure 20:
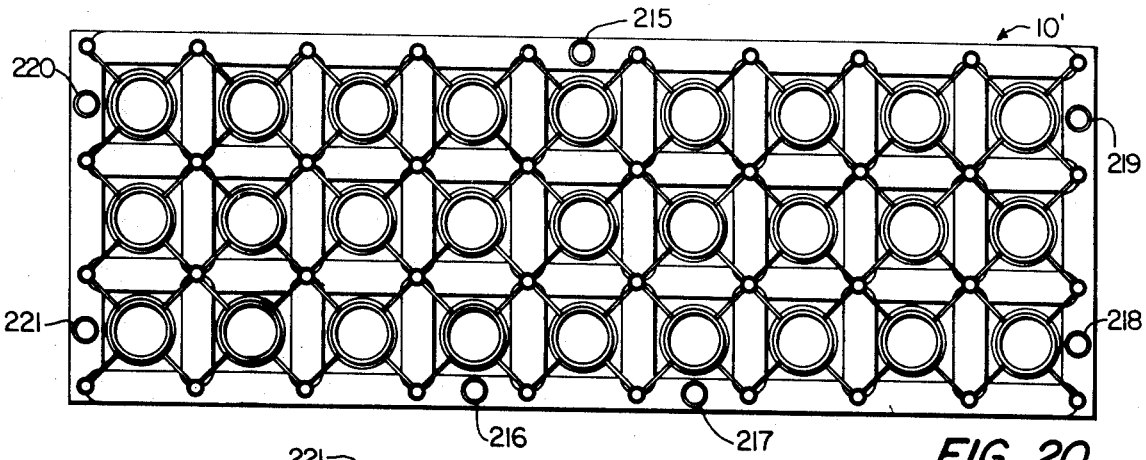
FIG. 20 is a top plan view of a modified template similar to that shown in FIG. 2 except that it has slots in a three by nine array.

This is seen in FIG. 19 where those parts shown in FIG. 10 and described above are referred to with the same reference numerals with the addition of a prime. The designation "RFP" indicates radial free play between the various parts illustrated.

Thus, there is radial free play between the casing pile 12 and the interior of upper plate 127' in the piston 118' and there is also radial free plate between the casing pile and the lower part of the interior of piston annular member 123'. Similarly, there is radial free play between the exterior of the gripping assembly 119' and the inner surface of annular member 123'.

There is also radial free play between the casing pile and the smallest inner diameter of the adaptor unit 97' and radial free play between the casing pile and the smallest inner diameter of the hub 31'. The gripping assembly 54' also has radial free play between its exterior and the interior of the hub 31'.

MODIFIED TEMPLATE

As seen in FIGS. 20–24, a larger template 10' is shown comprising three transverse sleeves or slots and nine longitudinal sleeves or slots in a three by nine array. This template 10' has three substantially centrally located hubs 215–217 similar to hubs 31–34 described above which will receive gripping assemblies 54 also described above. In addition, this template has four larger hubs 218–221 substantially in the four corners thereof. These hubs can also receive gripping assemblies similar to gripping assemblies 54 described above but larger.

Figure 21:
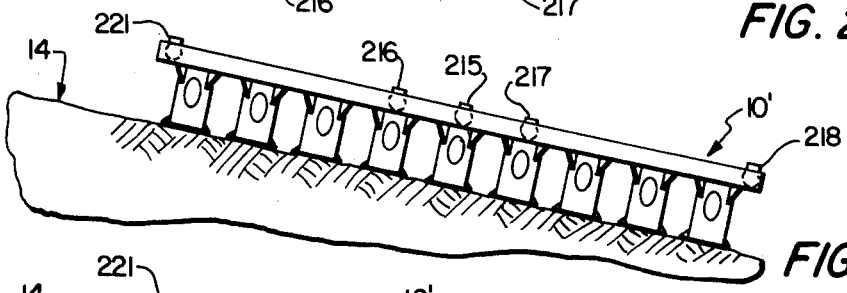
FIG. 21 is a diagramatic representation of the template shown in FIG. 20 having been landed on an inclined floor of a body of water.
Figure 22:
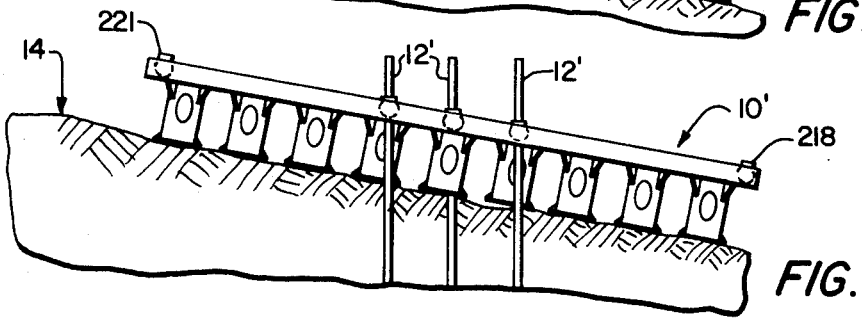
FIG. 22 is a diagramatic representation similar to that shown in FIG. 21 except that three piles have been implanted in the floor of the body of water in a substantially vertical orientation, have passed through passageways in the template and have portions extending above the template.

As seen in FIG. 21, the template 10' is landed on the floor 14 of the body of water. After the initial steps described above are completed, including drilling of bores for the casing piles, the gripping assemblies are lowered into the hubs 215–217 and then three casing piles 12' are implanted in the floor 14 and extend through the gripping assemblies with portions extending above the template 10'. In this configuration shown in FIG. 22, the casing piles 12' are straight and substantially vertical.

Figure 23:
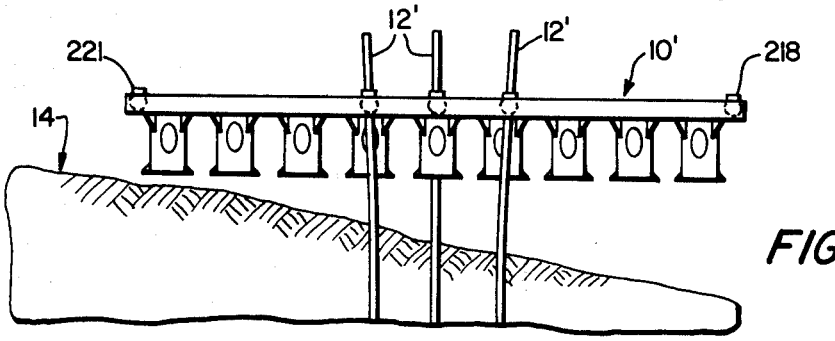
FIG. 23 is a diagramatic representation of the template shown in FIG. 22 except that the jacking assembly in accordance with the invention has been used to level the template and thereby deflect the piles transverse to their longitudinal axes.
Figure 24:
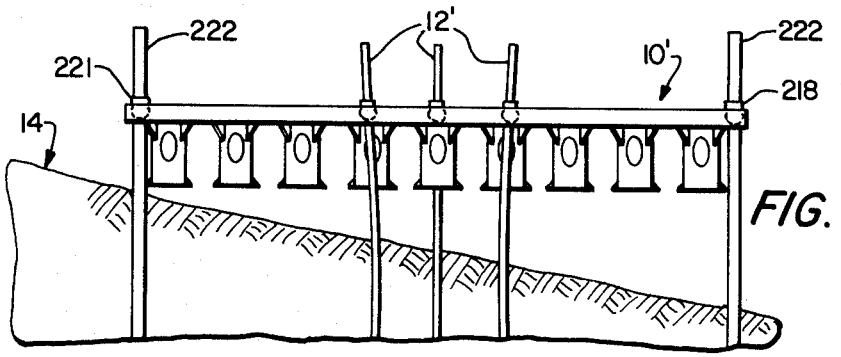
FIG. 24 is a diagramatic representation similar to that shown in FIG. 23 except that additional, less flexible piles have been implanted in the floor of the body of water and have been ridigly connected to the template.

Then, as seen in FIG. 23, after the jacking assembly in accordance with the present invention is utilized to level the template 10', the casing piles 12' are outwardly deflected transverse to their longitudinal axes.

Subsequent to this levelling, larger, less flexible piles 222 are implanted in the floor 14 and are received and gripped in hubs 218–221 using, for example, the gripping assemblies 54 described above to securely support the template in the level position.

DIVERLESS EMBODIMENT OF FIGS. 25 AND 26

As described above, in order to provide a fluid pressure line, i.e., a hydraulic line 115, to the gripping assembly 54 coupled to the hub 31 in FIGS. 5, 7, 8, 9 and 10, a diver must attach line 115 via hydraulic connecting device 114 to male nipple 91 after the hub 31 receives the gripping assembly 54. Male nipple 91 then delivers the hydraulic fluid to the pistons **82*a–f* in the gripping assembly 54. In order to render the apparatus diverless, that is, remotely deliver fluid under pressure from a fluid reservoir at the surface of the body of water without the necessity for an underwater manual connection, fluid under pressure must be directly delivered to the gripping assembly 54**.

A first embodiment for carrying out this remote delivery is shown in FIGS. 25 and 26 wherein the hub and the connector housing are modified.

Thus, a modified jacking assembly **18*a* includes a modified annular connecting housing 159*a* which has a horizontally oriented fluid passageway 240 formed completely through the wall of the housing and having two sealing rings 241 and 242 above and below the exit orifice of the passageway on the interior surface of housing 159*a*. The other entrance orifice for that passageway receives a connector 243 which couples hydraulic line 115 in fluid communication with passageway 240. This hydraulic line 115** is coupled to a fluid reservoir at the surface of the body of water, such as a tank carried on a surface platform or ship.

The hub **31*a* is also modified to include an external groove or gallery 244 which has a substantially trapezoidal cross-section and which is in fluid communication with a horizontal bore in the form of a fluid passageway 245. This passageway 245 is in fluid communication and intersects with a vertically oriented bore in the form of a fluid passageway 246 extending vertically of the wall of the hub, this passageway 246 being plugged at the top via plug 247 and intersecting and being in fluid communication with a second horizontally oriented bore or fluid passageway 248 extending completely across the wall of the hub. This passageway 248 is plugged via plug 249 on the outer surface of the hub and intersects with an internal groove or gallery 250 formed in the inner surface of the hub wall. This gallery 250 is in fluid communication with bore 90, best seen in FIG. 9, in upper ring 57 in the gripping assembly 54 so that fluid delivered to bore 90 can actuate pistons 82*a–f* in the gripping assembly 54**.

As seen in FIG. 25, the male nipple 91 shown in FIG. 9 is eliminated from the upper ring 57 and similarly the orienting key 95 shown in FIG. 9 coupled to the annular member 56 is also eliminated. Moreover, the internal vertical slot 109 shown in FIG. 10 on the inside of hub 31 is eliminated and so is the bore 112 shown in FIG. 10.

As shown in FIG. 25, the jacking assembly **18*a* is about to be landed on the hub 31*a*, and thus is in an orientation similar to that shown in FIG. 10**.

In FIG. 26, the jacking assembly is fully landed on the hub **31*a* which allows for remotely delivering fluid under pressure from a fluid reservoir at the surface of the body of water to the gripping assembly 54 by means of hydraulic line 115 and the various fluid passageways described above. Thus, fluid under pressure from the surface is delivered downwardly through the water via hydraulic line 115, passes through the housing 159*a* via passageway 240, enters the hub 31*a* via gallery 244 and passageway 245, and then flows downwardly via passageway 246. The fluid then flows radially inwardly of the hub via passageway 248 and gallery 250 at which time it is in communication with bore 90. This allows the fluid to actuate pistons 82*a–f* in gripping assembly 54. By so providing fluid to these pistons, the template can be adjusted downwardly relative to the pile 12**.

As is apparent from FIG. 25, the downward movement of the jacking assembly **18*a* on the pile 12 carries with it the hydraulic line 115 coupled thereto at the surface. The fluid can be delivered to the gripping assembly when the jacking assembly is coupled to the hub as seen in FIG. 26**.

DIVERLESS EMBODIMENT OF FIGS. 27 AND 28

As seen in FIGS. 27 and 28, a second embodiment for rendering the apparatus in accordance with the present invention diverless is illustrated and comprises a modified jacking assembly, a modified hub and a modified gripping assembly. The concept of remotely delivering fluid under pressure via hydraulic line 115 coupled to the jacking assembly to the gripping assembly in the hub is similar to that illustrated in FIGS. 25 and 26.

The modified jacking assembly **18*b* has a modified connector housing 159*b* which includes a horizontally oriented bore or fluid passageway 253 extending through the annular wall thereof and having suitable sealing rings above and below the exit orifice on the interior surface thereof and a connector 254 at the entrance orifice on the outer surface thereof for connection with hydraulic line 115**, which is connected to a fluid reservoir and suitable pump at the surface of the body of water.

The hub 31*b* is shortened at the top and the annular housing 255 at the top of the gripping assembly 254 has a frustoconical section 256 and an annular section 257. These sections fit over the similarly contoured top of the hub 31*b*. An external groove in the form of a gallery 258 is formed on the outer surface of the annular section 257 and communicates with a horizontal bore or fluid passageway 259 which connects with a diagonally oriented bore or fluid passageway 260 formed in the frustoconical section 256. This diagonal bore communicates with a vertically oriented bore 261 passing through annular housing 255 and is in fluid communication with vertically oriented bore 92 in ring 57, as seen in FIG. 9. Suitable sealing rings are utilized where necessary and while not shown for the sake of clarity the diagonal bore 260 can continue upwardly to the exterior of housing 255 where it is plugged.

As shown in FIG. 27, the jacking assembly 18*b* is about to be landed on hub 31*b*. This fully landed position is shown in FIG. 28 where fluid under pressure can be delivered via hydraulic line 115 to the gripping assembly 54. This fluid passes along fluid passageway 253, then through gallery 258 and along passageway 259 into passageway 260. From there the fluid passes downwardly through passageway 261 and into bore 92. From bore 92 the fluid can act on pistons 82*a–f* shown in FIG. 9.

DIVERLESS EMBODIMENT OF FIGS. 29 AND 30

A third embodiment for rendering the apparatus in accordance with the present invention diverless is illustrated in FIGS. 29 and 30 as well as FIG. 36.

The jacking assembly 18 is the same as that described above and illustrated in FIG. 10 while the hub 31*c* is modified. This hub has a horizontally oriented bore or fluid passageway 264 extending through the wall thereof and having an exit into an internal groove or gallery 265 located on the inner surface of the hub and in fluid communication with bore 90 in the gripping assembly 54. A valve 266 is coupled to the hub, for example, by being rigidly supported on a plate 267 which is in turn rigidly coupled to the hub. This valve could be located inside the hub if desired. The valve has a push-button 268 on the top which opens the valve when depressed downwardly. Interconnecting the valve with passageway 264 is a short fluid line 269 which is suitably connected to the hub in fluid communication with passageway 264. On the other side of the valve 266 is the hydraulic line 115 which delivers fluid under pressure to valve 266.

As seen in FIG. 36, a plurality of gripping assemblies 54 are schematically shown coupled via fluid lines 269 to a plurality of valves 266. These valves are also connected to hydraulic lines 115 which are in turn connected to a tee connector 270 forming a manifold. This manifold is coupled to the template 10 itself on the floor of the body of water, the gripping assemblies 54 being received in the hubs which are also coupled to the template. A connecting housing 272 is rigidly coupled to the template and is in fluid communication via line 273 with the manifold. This housing has a suitable gallery and sealing rings to provide a fluid connection between a stab-in connector 274 and line 273. This stab-in connector has a vertical bore 275 and a horizontal bore 276 in fluid communication with bore 275. Bore 276 communicates with line 273. Bore 275 is in fluid communication with line 277 which extends to the surface 278 of the body of water where line 277 is in fluid communication with a fluid reservoir 279 shown for example in FIG. 36 as being supported by a ship 280. The stab-in connector 274 is lowered from the ship 280 via lowering line 281 which is suitably connected to a hoist or crane on the ship. The stab-in connector is guided into the connecting housing 272 by guidlines or other suitable guiding mechanisms. In all events, fluid from the reservoir 279 at the surface 278 is delivered via line 277, connector 274 and line 273 to the manifold of connector 270 and lines 115 where it is distributed to the plurality of valves 266 located adjacent each of the gripping assemblies.

As seen in FIG. 29, the jacking assembly 18 is about to be landed on hub 31*c*. This fully landed condition is shown in FIG. 30 where the bottom surface of connector housing 159 on the jacking assembly 18 has depressed push-button 268 thereby activating and opening the valve 266. Once valve 266 is open, fluid under pressure from line 115 passes through valve 266 and into the passageway 264 in the hub via line 269 and then into bore 90 where fluid activates pistons 82*a–f* in the gripping assembly 54.

DIVERLESS EMBODIMENT OF FIGS. 31 AND 32

A fourth embodiment for rendering the present invention diverless is shown in FIGS. 31 and 32 which is similar to that shown in FIGS. 29 and 30 except that a fluid-activated member coupled to the jacking assembly is used to separately activate the push-button 268 on valve 266.

Thus, the connector housing 159*c* at the bottom of the jacking assembly 18*c* is somewhat shorter than that shown in FIG. 29 and has supported at the bottom thereof an L-shaped ring 285 with a vertical portion 286 and a horizontal portion 287, horizontal portion 287 being in a position to contact and depress push-button 268 upon downward movement thereof. Ring 285 is supported on a plurality of cylinders 288, which are suitably rigidly supported on the outside of housing 159*c*, by means of a plurality of piston rods 289 rigidly coupled to the top of the vertical portion 286 of the ring and having a plurality of pistons 290 slidably received inside cylinders 288 and biased upwardly via coiled compression springs 291. A suitable bore is located at the bottom of each cylinder 288 for the reception of the piston rod 289 therein, spring 291 acting between the bottom of each cylinder and the bottom of each piston 290. A fluid line 292 is suitably connected in fluid communication with the inside of each cylinder above the piston, line 292 also being coupled to a fluid reservoir at the surface of the body of water.

As seen in FIG. 31, when the jacking assembly 18*c* is fully landed on hub 31*c*, the horizontal portion 287 of the ring 285 does not yet contact or depress the push-button 268. This does not occur until fluid under pressure is delivered to cylinder 288 via line 292 at which time it pushes the piston 290 downwardly so as to also push down piston rod 289 against the force of spring 291 resulting in a downward movement of ring 285. This downward movement contacts the ring horizontal portion 287 with push-button 268 to open valve 266. Valve 266 then delivers fluid under pressure to the gripping assembly 54 as discussed above regarding the embodiment of FIGS. 29 and 30. Thus, ring 285 is a fluid-activated member being activated by fluid in line 292 which is connected to a fluid reservoir at the surface of the body of water.

DIVERLESS EMBODIMENT OF FIGS. 33-35

A fifth embodiment for rendering the present invention diverless is illustrated in FIGS. 33-35 and includes a spool valve 295 received inside the wall of the hub 31*d* and actuated by the spring-bias locking dog 170 which is also utilized for releasably coupling the jacking assembly 18 to the hub, as seen in FIG. 33 as well as FIG. 11.

The spool valve 295 is in fluid communication with hydraulic line 115 which is connected to a manifold coupled to the template in a fashion similar to that shown in FIG. 36.

As seen in FIG. 33, the wall of hub 31*d* has a pair of diagonal substantially parallel bores or fluid passageways 298 and 299 extending diagonally upwardly and inwardly from the outer surface of the hub wall to the inner surface thereof. At the inner surface, each of these fluid passageways is closed by a plug 300 and 301, respectively. At the outer surface of the hub wall fluid passageway 298 is connected for transmission of fluid with hydraulic line 115 via connector 302. At the outer surface of the hub wall fluid passageway 299 is coupled via connector 303 to a fluid jumper line 304 which is also connected via connector 305 to a horizontal bore or fluid passageway 306 extending completely through the wall of the hub and ending in a groove or gallery 307 on the inside surface of the wall. This groove 307 is in fluid communication with bore 90 in the gripping assembly 54 so that fluid flowing through passageway 306, groove 307 and bore 90 will ultimately act on the pistons 82*a-f* in the gripping assembly 54.

As seen in FIGS. 33-35, the spool valve 295 is received in a diagonal bore 308 formed in the hub wall substantially perpendicular to bores 298 and 299 and communicating with external groove 160 receiving the locking dog 170 therein. Adjacent the locking dog there is an enlarged cylindrical groove 309 in bore 308 for receiving a split ring 310 which contacts the forward face of the spool valve and thereby maintains the valve inside the hub. A pair of circular grooves 310 and 311 in the form of galleries are formed in bore 308 in fluid communication with bores 298 and 299 respectively.

As best seen in FIGS. 34 and 35, the spool valve 295 comprises a cylindrical housing 313 and an actuator 314 longitudinally movable in the housing. The housing 313 is a cylindrical body having a central cylindrical chamber 315, a front cylindrical opening 316 of smaller diameter, and a rear threaded bore 318 of larger diameter and threadedly receiving a cylindrical cap 319. This cap has a central bore 320 therein for the reception of part of the actuator 314 and fits into a bore 321 in the hub wall in communication with bore 308 but having a smaller diameter. The chamber 315, opening 316, and threaded bore 318 all extend along the longitudinal axis of the cylindrical housing 313.

Extending radially outwards from the middle of the chamber 315 is a radial bore 322 which is in fluid communication with gallery 311 adjacent the periphery of the housing 313 and is in fluid communication with a gallery 323 formed in the surface of cylindrical chamber 315.

As seen in FIG. 34, two additional radial bores 325 and 326 are formed in housing 313, bore 326 extending between the surface defining chamber 315 adjacent cap 319 to the outer cylindrical surface of housing 313 where this radial bore 326 is closed via plug 327. The other radial bore 325 extends from a position aligned with gallery 310 radially inwards of the housing and into a fluid communication and intersection with a longitudinally extending, off-center bore 328 which is plugged at the forward end of housing 313 via plug 329 and also intersects with and forms a fluid communication with radial bore 326.

The actuator 314 as shown in FIG. 34 comprises a first cylindrical portion 331, a second cylindrical portion 332 having a diameter larger than portion 331 and a third cylindrical portion 333 having a diameter substantially equal to the diameter of the first cylindrical portion. These three portions are longitudinally aligned and have a central longitudinal venting bore 334 extending therethrough. The second cylindrical portion 332 is received in chamber 315 of the housing.

Formed in the second cylindrical portion 332 is a longitudinally offset through bore 336 which begins at the front face 335 of the second cylindrical portion and extends to the rear exposed face 337 of that second cylindrical portion 332. Interposed between that rear face 337 and the forward face of cap 319 is a compression coil spring 338 which biases the second cylindrical portion 332 to a position where offset bore 336 does not communicate with gallery 323 and wherein the first cylindrical portion 331 extends outwardly considerably past split ring 310. As seen in FIG. 34, suitable seals are provided to prevent the fluid under pressure utilized in the valve from escaping from its intended passageways.

In operation, when the locking dog 170 is fully received in external groove 160 in the hub, which occurs when the jacking assembly 18 is fully landed on the hub, the locking dog 170 depresses the first cylindrical portion 331 on the actuator 314 to move it from its closed position shown in FIG. 34 to the open position shown in FIGS. 33 and 35. As shown in detail in FIG. 35, fluid from hydraulic line 115 flows to the spool valve 295 via passageway 298 and then continues around the valve via gallery 310 and enters the valve via radial bore 325. From there, the fluid extends along longitudinal bore 328 and then radially inward along bore 326. The fluid then extends from housing 313 through the space between the actuator 314 and the housing and enters the actuator via bore 336. The fluid then exits from the actuator via bore 336 and extends around the outside of the actuator 323 and enters the housing once again via radial bore 322. From bore 322 the fluid extends around the housing 313 via gallery 311 and then is transmitted along bore 299 through line 304 and into line 306 in the hub. From there, the fluid passes through gallery 307 and into bore 90 where it continues in the gripping assembly 54 to actuate the pistons 82*a-f*.

DIVERLESS EMBODIMENT OF FIG. 37

The sixth embodiment for rendering the present invention diverless is shown in FIG. 37 which is very similar to that shown in FIG. 5 except that internal slot 109 and bore 112 are removed in favor of an upwardly opening slot 341 extending completely through the wall of hub 31*e*. Thus, with hydraulic line 115 connected to male nipple 91 on the gripping assembly via hydraulic connecting device 114, the gripping assembly can be maneuvered into the hub 31*e* with the line 115 and connecting device 114 passing downwardly through slot 341. This hydraulic connection of line 115 can be accomplished at the surface of the water with gripping assembly 54 being lowered preconnected to the hydraulic line as shown in FIG. 37. As seen in FIG. 8, nipple 91 is in communication with bore 90 and ultimately pistons 82*a–f* so that fluid under pressure in line 115 can actuate these pistons when desired.

While advantageous embodiments have been chosen to illustrate the invention, it will be understood by those skilled in the art that various changes and modifications can be made therein without departing from the scope of the invention as defined in the appended claims.

What is claimed is:

1. A subsea template levelling system for levelling a template adjacent the seabed on a plurality of piles implanted in a seabed, the combination comprising:

an open ended hub haviing a pile received therein;

means for pivotally coupling said hub to the template in a passageway in the template;

first gripping means, coupled to said hub, for releasably gripping the pile received in said hub, said first gripping means being fluid-pressure activated;

a housing;

means for releasably coupling said housing to said hub;

second gripping means, slidably received in said housing, for releasably gripping the pile received in said hub;

means on the exterior of said second gripping means and on the interior of said housing for limiting the slidable movement of said second gripping means relative to said housing;

means for unlocking and locking said first and second gripping means and for reciprocating said second gripping means relative to said housing to raise and lower the template relative to the pile received in said hub; and means for remotely delivering fluid under pressure from a fluid reservoir at the sea surface to said first gripping means without the necessity for an underwater manual connection.

2. A system according to claim 1, wherein said means for remotely delivering fluid comprises a fluid pressure line coupled to a fluid reservoir at the surface and coupled to said housing, a first fluid passageway in said housing for conducting fluid from said fluid pressure line through said housing, and a second fluid passageway formed in said hub for conducting fluid from said first fluid passageway to said first gripping means.

3. A system according to claim 1, wherein said means for remotely delivering fluid comprises a fliud pressure line coupled to a fluid reservoir at the surface and coupled to said housing, a first fluid passageway in said housing for conducting fluid from said fluid pressure line through said housing and to said first gripping means.

4. A system according to claim 1, wherein said means for remotely delivering fluid comprises a fluid pressure line coupled to a fluid reservoir at the surface, a valve coupled to said hub and having a push-button actuator, means for coupling said fluid pressure line to one side of said valve, means for conducting fluid from the other side of said valve to said first gripping means, and means, coupled to said housing, for activating said push-button actuator.

5. A system according to claim 4, wherein said means for conducting fluid from the other side of said valve to said first gripping means comprises a fluid passageway formed in said hub.

6. A system according to claim 4, wherein said means for activating said push-button actuator comprises contact with said housing when said housing is coupled to said hub.

7. A system according to claim 4, wherein said means for activating said push-button actuator comprises a fluid-activated member coupled to said housing and capable of downward movement into contact with said push-button.

8. A system according to claim 7, and further comprising a second fluid pressure line coupled to a fluid reservoir at the surface and coupled to said fluid-acivated member.

9. A system according to claim 7, wherein said fluid-activated member comprises a ring.

10. A system according to claim 4, wherein said means for activating said push-button actuator comprises said means for releasably coupling said housing to said hub.

11. A system according to claim 10, wherein said valve comprises a spool valve located inside a wall of said hub.

12. A system according to claim 4, wherein said means for activating said push-button actuator comprises a spring-biased locking dog slidably coupled to said housing.

13. A system according to claim 4, wherein said push-button actuator extends into an external groove formed in said hub.

14. A system according to claim 4, wherein said means for coupling said fluid pressure line to one side of said valve comprises a fluid manifold coupled to said valve and supported by the template, and means for coupling said fluid pressure line to said manifold.

15. A system according to claim 1, wherein said means for remotely delivering fluid comprises a fluid pressure line coupled to a fluid reservoir at the surface and coupled to a side of said hub, a fluid passageway formed in said hub for conducting fluid from said fluid pressure line to said first gripping means, and a slot passing completely through the wall of said hub and receiving a portion of said fluid pressure line therein.

16. A system according to claim 1, and further comprising means for activating said means for remotely delivering fluid when said housing is coupled to said hub.

17. A method of installing a subsea template adjacent the floor of a body of water, the steps comprising lowering the template through the water and landing the template on the floor of the body of water, lowering a set of fluid-pressure activated gripping assemblies and landing these assemblies in the passageways in the template, lowering a set of casing piles and landing these piles in the gripping assemblies and implanting the casing piles in the floor of the body of water with portions of the casing piles extending above the gripping assemblies, and lowering a jacking assembly down each of the piles, releasably coupling the jacking assembly to the template adjacent each gripping assembly, and actuating the jacking assembly and each gripping assembly to raise or lower the template adjacent each pile to thereby level the template, the step of actuating each gripping assembly being preceded by the step of remotely delivering fluid under pressure from a fluid reservoir at the sea surface to each gripping assembly without underwater manual intervention.

18. A method according to claim 17, wherein the remotely delivering step comprises the step of opening a valve coupled to the template.

19. A method according to claim 18, wherein the step of opening a valve comprises the step of releasably coupling the jacking assembly to the template.

20. A method according to claim 18, wherein the step of opening a valve comprises the step of delivering fluid under pressure from the sea surface to a valve actuator carried by the jacking assembly.

21. A method of installing a subsea template adjacent the floor of a body of water, the steps comprising lowering the template through the water and landing the template on the floor of the body of water, lowering a set of fluid-pressure activated gripping assemblies and landing these assemblies in the passageways in the template, lowering a set of casing piles and landing these piles in the gripping assemblies and implanting the casing piles in the floor of the body of water with portions of the casing piles extending above the gripping assemblies, and lowering a jacking assembly down each of the piles, releasably coupling the jacking assembly to the template adjacent each gripping assembly, and actuating the jacking assembly and each gripping assembly to raise or lower the template adjacent each pile to thereby level the template, the step of releasably coupling the jacking assembly to the template adjacent each gripping assembly comprising the step of delivering fluid under pressure to each of the gripping assemblies.

22. A method of installing a subsea template adjacent the floor of a body of water, the steps comprising lowering the template through the water and landing the template on the floor of the body of water, lowering a set of fluid-pressure activated gripping assemblies and landing these assemblies in the passageways in the template, lowering a set of casing piles and landing these piles in the gripping assemblies and implanting the casing piles in the floor of the body of water with portions of the casing piles extending above the gripping assemblies, and lowering a jacking assembly down each of the piles, releasably coupling the jacking assembly to the template adjacent each gripping assembly, and actuating the jacking assembly and each gripping assembly to raise or lower the template adjacent each pile to thereby level the template, the step of lowering a set of fluid-pressure activated gripping assemblies being preceded by the step of coupling a fluid pressure line to each of the gripping assemblies.

23. A subsea template levelling system for levelling a template adjacent the seabed on a plurality of piles implanted in a seabed, the combination comprising:

an open ended hub having a pile received therein;

means for pivotally coupling said hub to the template in a passageway in the template, first gripping means, coupled to said hub, for releasably gripping the pile received in said hub, said first gripping means being fluid-pressure activated;

a housing;

means for releasably coupling said housing to said hub;

second gripping means, slidably received in said housing, for releasably gripping the pile received in said hub;

means on the exterior of said second gripping means and on the interior of said housing for limiting the slidable movement of said second gripping means relative to said housing;

means for unlocking and locking said first and second gripping means and for reciprocating said second gripping means relative to said housing to raise and lower the template relative to the pile received in said hub; and means for delivering fluid under pressure from a fluid reservoir at the sea surface to said first gripping means.

* * * * *